US009417028B2

(12) United States Patent
Hyde et al.

(10) Patent No.: US 9,417,028 B2
(45) Date of Patent: Aug. 16, 2016

(54) ADJUSTABLE PULLEY ASSEMBLY FOR A COMPOUND ARCHERY BOW

(71) Applicant: BowTech, Inc., Eugene, OR (US)

(72) Inventors: Tony E. Hyde, Monroe, OR (US); Nicholas C. Obteshka, Springfield, OR (US)

(73) Assignee: BOWTECH, INC., Eugene, OR (US)

( * ) Notice: Subject to any disclaimer, the term of this patent is extended or adjusted under 35 U.S.C. 154(b) by 10 days.

(21) Appl. No.: 14/591,007

(22) Filed: Jan. 7, 2015

(65) Prior Publication Data

US 2016/0195353 A1 Jul. 7, 2016

(51) Int. Cl.
*F41B 5/10* (2006.01)
*F41B 5/14* (2006.01)

(52) U.S. Cl.
CPC . *F41B 5/105* (2013.01); *F41B 5/10* (2013.01); *F41B 5/1403* (2013.01); *Y10S 124/90* (2013.01)

(58) Field of Classification Search
CPC ..... F41B 5/105; F41B 5/10; Y10S 124/90
USPC ..... 124/23.1, 25.6, 900
See application file for complete search history.

(56) References Cited

U.S. PATENT DOCUMENTS 4,519,374 A * 5/1985 Miller ..... F41B 5/10 124/25.6
4,562,824 A 1/1986 Jennings
4,660,536 A 4/1987 McPherson
4,926,832 A 5/1990 Darlington
4,976,250 A 12/1990 Jeffrey
5,678,529 A 10/1997 Larson
5,782,229 A * 7/1998 Evans ..... F41B 5/105 124/25.6
5,791,322 A * 8/1998 McPherson ..... F41B 5/10 124/25.6
5,934,265 A * 8/1999 Darlington ..... F41B 5/10 124/25.6
5,960,778 A * 10/1999 Larson ..... F41B 5/10 124/25.6
6,067,974 A 5/2000 Islas
6,082,347 A * 7/2000 Darlington ..... F41B 5/10 124/25.6
6,112,732 A 9/2000 Larson
6,155,243 A 12/2000 Gallops, Jr.
6,250,293 B1 * 6/2001 Andrews ..... F41B 5/10 124/25.6
RE37,544 E * 2/2002 Darlington ..... F41B 5/105 124/25.6
6,446,619 B1 9/2002 McPherson
6,460,528 B1 * 10/2002 Gallops, Jr. ..... F41B 5/105 124/25
6,474,324 B1 11/2002 Despart et al.
6,516,790 B1 * 2/2003 Darlington ..... F41B 5/10 124/25.6

(Continued)

OTHER PUBLICATIONS

Allowance dated Mar. 21, 2016 in co-owned U.S. Appl. No. 14/318,640 (published as US 2015/0377581; issued as U.S. Pat. No. 9,347,730).

(Continued)

*Primary Examiner* — Alexander Niconovich
(74) *Attorney, Agent, or Firm* — David S. Alavi

(57) ABSTRACT

A pulley assembly for a compound bow comprises a draw cable pulley and a power module attached to the draw cable pulley and adjustable among one or more positions and two orientations. Changing the power module orientation at a given power module position alters the bow's draw force curve and stored energy without altering the bow's draw length or draw weight.

33 Claims, 11 Drawing Sheets

(56) References Cited

U.S. PATENT DOCUMENTS 6,575,153 B2 * 6/2003 Lommasson ..... F41B 5/10 124/25.6
6,691,692 B1 * 2/2004 Adkins ..... F41B 5/10 124/25.6
6,718,963 B1 4/2004 Wheeler
6,792,930 B1 9/2004 Kronengold et al.
6,871,643 B2 * 3/2005 Cooper ..... F41B 5/10 124/25.6
6,966,312 B1 11/2005 Larson
6,976,484 B1 * 12/2005 Gallops, Jr. ..... F41B 5/10 124/25.6
6,990,970 B1 * 1/2006 Darlington ..... F41B 5/10 124/25.6
6,994,079 B1 * 2/2006 Darlington ..... F41B 5/10 124/25.6
7,082,937 B1 * 8/2006 Land ..... F41B 5/105 124/25.6
7,305,979 B1 * 12/2007 Yehle ..... F41B 5/105 124/25.6
7,311,098 B2 12/2007 Gallops, Jr.
7,673,626 B1 * 3/2010 Hennings ..... F41B 5/105 124/25.6
7,690,372 B2 4/2010 Cooper et al.
7,721,721 B1 * 5/2010 Kronengold ..... F41B 5/105 124/16
7,770,568 B1 8/2010 Yehle
8,020,544 B2 * 9/2011 McPherson ..... F41B 5/10 124/23.1
8,082,910 B1 * 12/2011 Yehle ..... F41B 5/105 124/23.1
8,181,638 B1 * 5/2012 Yehle ..... F41B 5/10 124/25.6
8,205,607 B1 * 6/2012 Darlington ..... F41B 5/105 124/23.1
8,220,446 B2 * 7/2012 Batdorf ..... F41B 5/10 124/25.6
8,469,013 B1 * 6/2013 Obteshka ..... F41B 5/10 124/23.1
8,544,456 B2 * 10/2013 Grace ..... F41B 5/10 124/23.1
8,662,062 B2 * 3/2014 Darlington ..... F41B 5/10 124/23.1
8,671,925 B2 * 3/2014 Grace ..... F41B 5/10 124/25.6
8,683,989 B1 * 4/2014 McPherson ..... F41B 5/105 124/25.6
8,739,769 B1 6/2014 Obteshka et al.
9,121,658 B1 * 9/2015 Darlington ..... F41B 5/105
9,347,730 B2 5/2016 Obteshka
2002/0144675 A1 10/2002 Lommasson et al.
2004/0003806 A1 1/2004 Blahnik
2004/0074485 A1 4/2004 Cooper et al.
2005/0193998 A1 9/2005 Cooper et al.
2005/0268892 A1 12/2005 Gallops
2006/0000463 A1 1/2006 Gallops
2009/0188482 A1 * 7/2009 Strother ..... F41B 5/10 124/25.6
2010/0051005 A1 * 3/2010 Wilson ..... F41B 5/105 124/25.6
2010/0212647 A1 * 8/2010 Eee ..... F41B 5/105 124/25.6
2013/0074819 A1 * 3/2013 McPherson ..... F41B 5/105 124/25.6
2015/0377581 A1 12/2015 Obteshka

OTHER PUBLICATIONS

Co-owned U.S. Appl. No. 14/797,072, filed Jul. 11, 2015 in the name of Obteshka.
Co-owned U.S. Appl. No. 15/091,572, filed Apr. 6, 2016 in the names of Eacker et al.

* cited by examiner

ADJUSTABLE PULLEY ASSEMBLY FOR A COMPOUND ARCHERY BOW

BACKGROUND

The field of the present invention relates to a pulley assembly for a compound archery bow. In particular, an adjustable pulley assembly is disclosed herein having a reversible power module mounted on a draw cable pulley for providing adjustment of draw force curve and stored energy of the drawn bow without substantially altering the draw length or the draw weight.

Several adjustable pulley assemblies are available for compound archery bows. Some examples are disclosed in: U.S. Pat. No. 7,721,721 entitled "Reversible and adjustable module system for archery bow" issued May 25, 2010 to Kronengold et al.; U.S. Pat. No. 8,020,544 entitled "Archery bow with force vectoring anchor" issued Sep. 20, 2011 to McPherson; co-owned U.S. Pat. No. 8,082,910 entitled "Pulley assembly for a compound archery bow" issued Dec. 27, 2011 to Yehle; and co-owned application Ser. No. 14/318,640 entitled "Adjustable pulley assembly for a compound archery bow" filed Jun. 28, 2014 in the name of Obteshka. U.S. application Ser. No. 14/318,640 is incorporated by reference as if fully set forth herein.

SUMMARY

A pulley assembly for a compound archery bow comprises a draw cable pulley and a power module substantially rigidly attached to the draw cable pulley. The draw cable pulley is structurally arranged so as to (i) define a first pulley assembly transverse rotation axis, (ii) be mounted on a first limb of an archery bow to rotate about the first pulley assembly axis, (iii) receive a first end of a draw cable of the bow in a circumferential draw cable journal of the draw cable pulley, and (iv) let out the first end of the draw cable when the bow is drawn and the draw cable pulley rotates about the first pulley assembly axis. One or both of the draw cable pulley and the power module are structurally arranged so as to enable substantially rigid attachment of the power module to the draw cable pulley in any one of one or more power module positions and, for each power module position, in any one of two power module orientations. The power module is structurally arranged so as to (i) receive a power cable of the bow in a circumferential power cable journal of the power module, and (ii) take up the power cable when the bow is drawn and the draw cable pulley rotates about the first pulley assembly axis. Each one of the one or more power module positions results in a corresponding draw length of the bow and a corresponding draw weight of the bow. For each one of the one or more power module positions, the two power module orientations result in substantially the same draw length of the bow and substantially the same draw weight of the bow. For each one of the one or more power module positions, the two power module orientations result in differing stored energies of the drawn bow.

A first method for adjusting the pulley assembly comprises: removing the power module from a first one of the one or more power module positions and a first one of the two power module orientations on the draw cable pulley; and reattaching the power module to the draw cable pulley in the first one of the one or more power module positions and in the other one of the two power module orientations, thereby altering the stored energy of the drawn bow without substantially altering the draw length of the bow and without substantially altering the draw weight of the bow. A second method for adjusting the pulley assembly comprises: removing the power module from a first one of multiple power module positions and a first one of the power module orientations on the draw cable pulley; and reattaching the power module to the draw cable pulley in a different one of the multiple power module positions and in one of the power module orientations, thereby altering the draw length of the bow or the draw weight of the bow.

An archery bow comprises a central riser, first and second bow limbs secured to opposing ends of the riser, first and second pulley assemblies rotatably mounted on the first and second bow limbs, respectively, a draw cable and a power cable. One or both of the pulley assemblies is arranged as described above. Instead of a second pulley assembly, an idler wheel can be rotatably mounted on the second bow limb.

Objects and advantages pertaining to pulley assemblies for compound bows may become apparent upon referring to the example embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1:
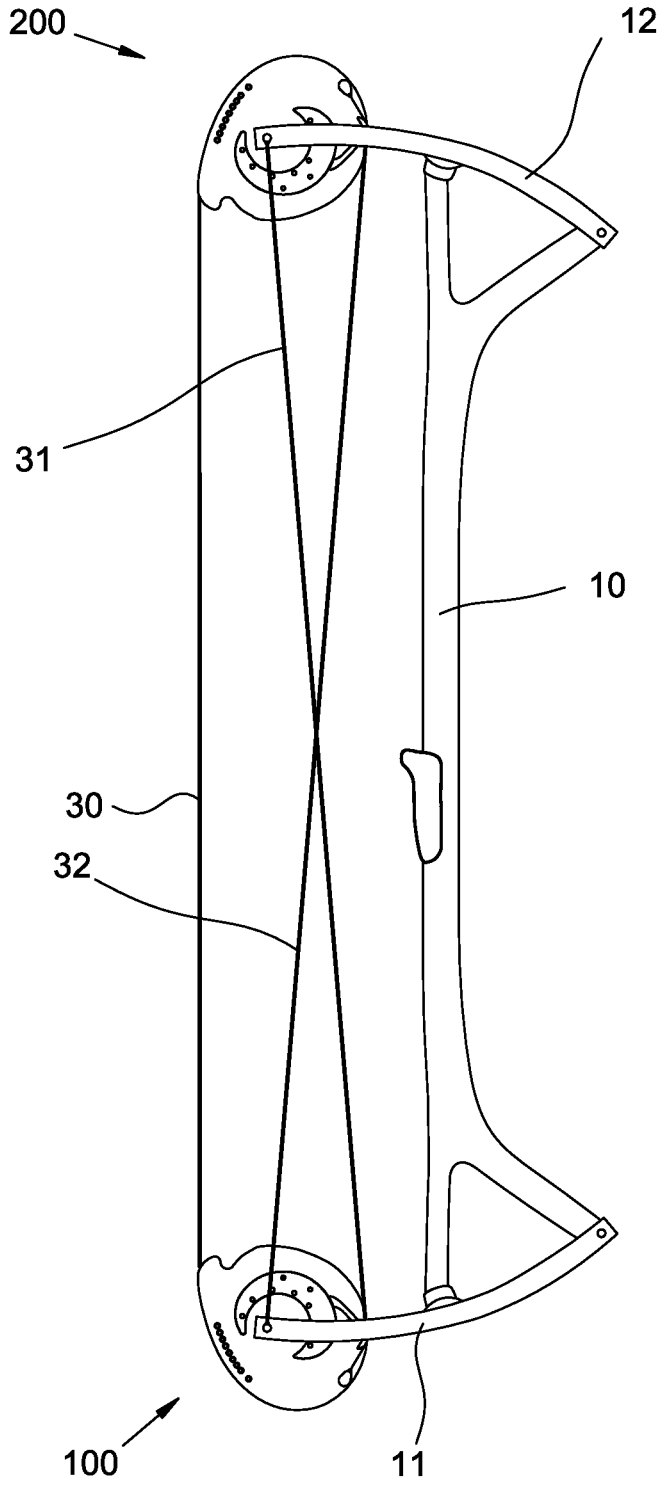
FIG. 1 illustrates schematically an example of a so-called dual cam archery bow incorporating a pair of example inventive pulley assemblies.

It should be noted that the embodiments depicted are shown only schematically, and that not all features may be shown in full detail or in proper proportion. Certain features or structures may be exaggerated relative to others for clarity. It should be noted further that the embodiments shown are examples only, and should not be construed as limiting the scope of the present disclosure or appended claims. In particular, the arrangement of the riser and limbs shown in FIGS. 1-4 and 11 are illustrative only; any suitable arrangement of the riser and bow limbs can be employed within the scope of the present disclosure or appended claims.

DETAILED DESCRIPTION OF EMBODIMENTS

A compound archery bow comprises a central riser 10, first and second bow limbs 11 and 12 secured to opposing ends of the riser 10, first and second pulley assemblies 100 and 200 rotatably mounted on the first and second bow limbs 11 and 12, respectively, a draw cable 30, and a power cable 31. If the bow is a so-called dual cam bow (FIGS. 1 and 11) or a so-called binary cam bow (FIG. 2), then the bow includes a second power cable 32 and the first and second pulley assemblies 100 and 200 are substantially identical or substantial mirror images of each other. Upon drawing a dual cam bow, the draw cable 30 is let out by both pulley assemblies 100 and 200, the power cable 31 (which is attached, directly or indirectly, to the second bow limb 12) is taken up by the first pulley assembly 100, and the second power cable 32 (which is attached, directly or indirectly, to the first bow limb 11) is taken up by the second pulley assembly 200. Upon drawing a binary cam bow, the draw cable 30 is let out by both pulley assemblies 100 and 200, the power cable 31 is let out by the second pulley assembly 200 and taken up by the first pulley assembly 100, and the second power cable 32 is let out by the first pulley assembly 100 and taken up by the second pulley assembly 200.

If the bow is a so-called solo cam bow (FIG. 3), then instead of a second pulley assembly an idler wheel 201 is rotatably mounted on the second bow limb 12. The draw cable 30 passes around the idler wheel 201 and is connected at both ends to the first pulley assembly 100. Upon drawing a solo cam bow, both ends of the draw cable 30 are let out by the first pulley assembly 100. The power cable 31 is taken up at its first end by the first pulley assembly 100; the second end of the power cable 31 typically is attached, directly or indirectly to the second bow limb 12; in some examples the power cable 31 instead can be let out by a power cable let-out pulley coupled to the idler wheel 201 (in a manner similar to that of a binary cam bow). If the bow is a so-called hybrid cam bow (FIG. 4), then the bow includes an additional coupling cable 33 connected to the first and second pulley members 100 and 200. Upon drawing a hybrid cam bow, the draw cable 30 is let out by both pulley assemblies 100 and 200 and the coupling cable 33 is let out by the first pulley assembly 100 and taken up by the second pulley assembly 200. The power cable 31 is taken up at its first end by the first pulley assembly 100; the second end of the power cable 31 typically is attached, directly or indirectly to the second bow limb 12; in some examples the power cable 31 instead can be let out by a power cable let-out pulley of the second pulley assembly 200 (in a manner similar to that of a binary cam bow).

Figure 2:
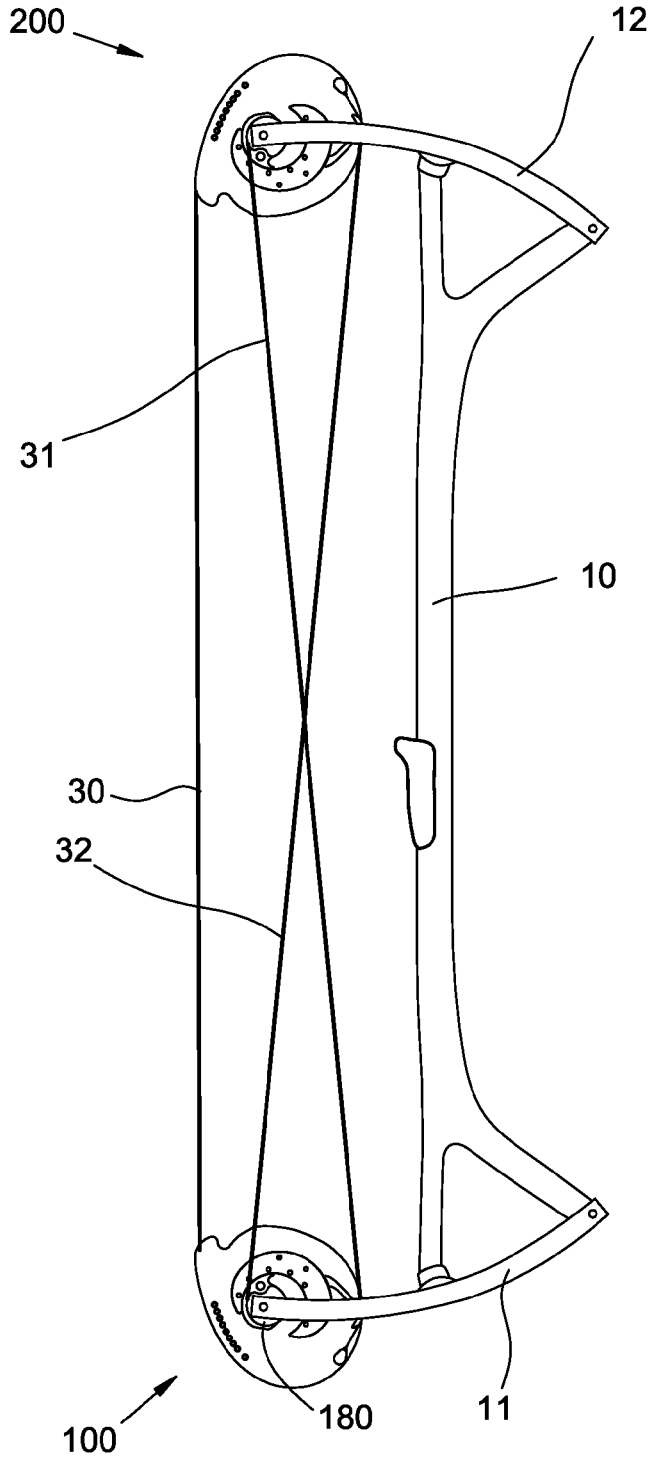
FIG. 2 illustrates schematically an example of a so-called binary cam archery bow incorporating another pair of example inventive pulley assemblies.
Figure 3:
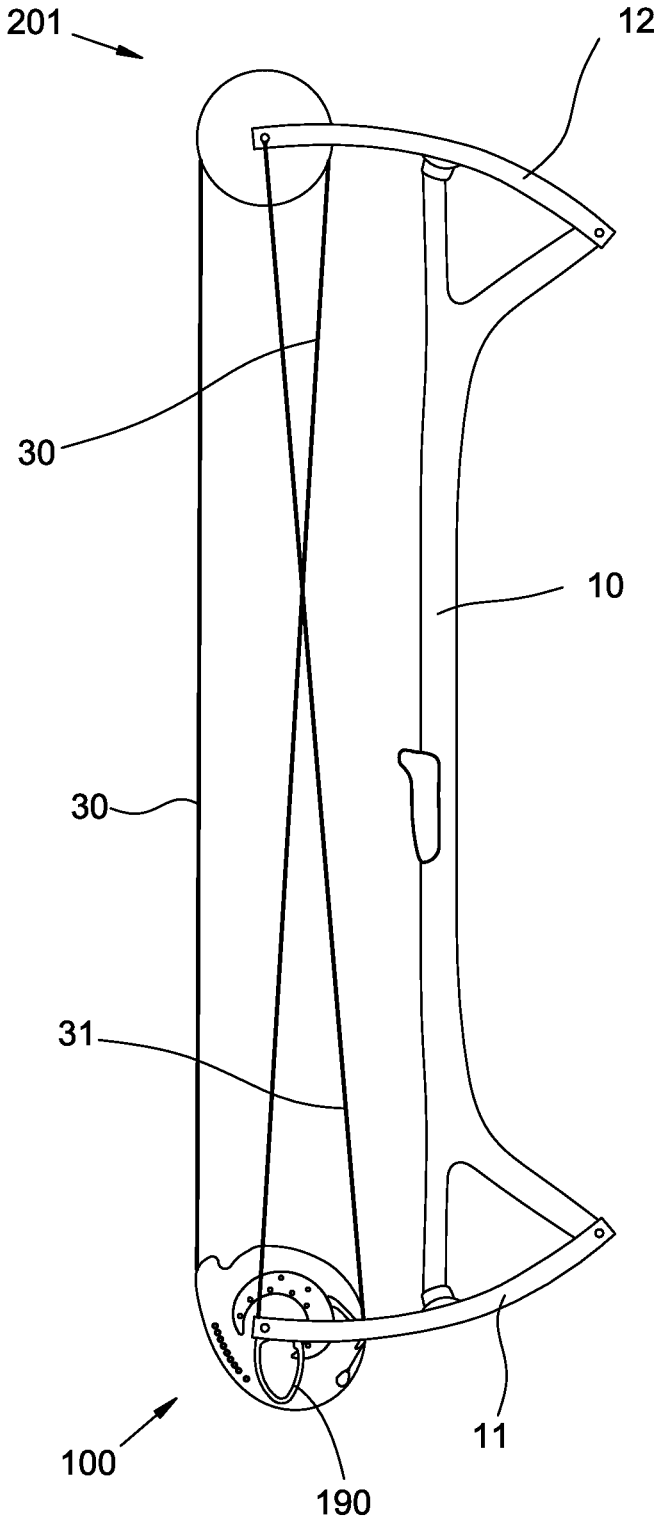
FIG. 3 illustrates schematically an example of a so-called solo cam archery bow incorporating another example inventive pulley assembly.
Figure 4:
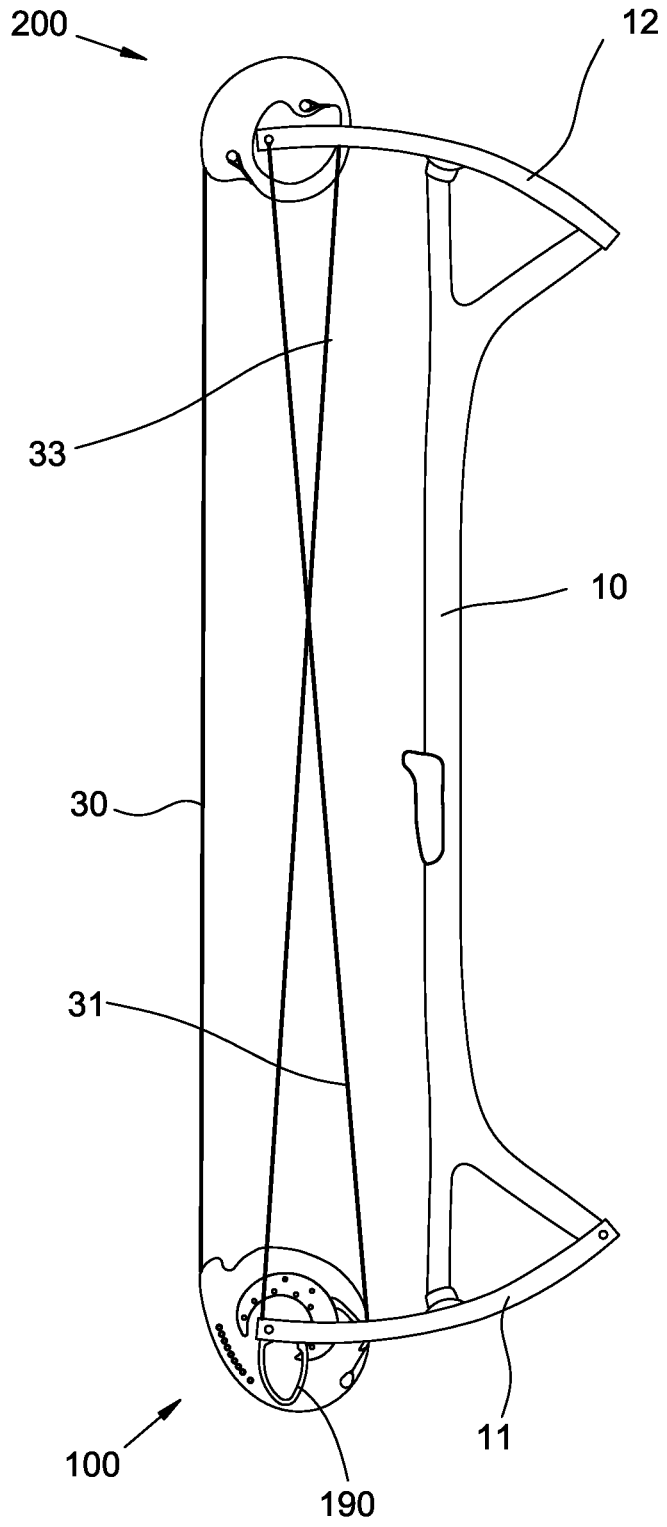
FIG. 4 illustrates schematically an example of a so-called hybrid cam archery bow incorporating another example inventive pulley assembly.
Figure 5A:
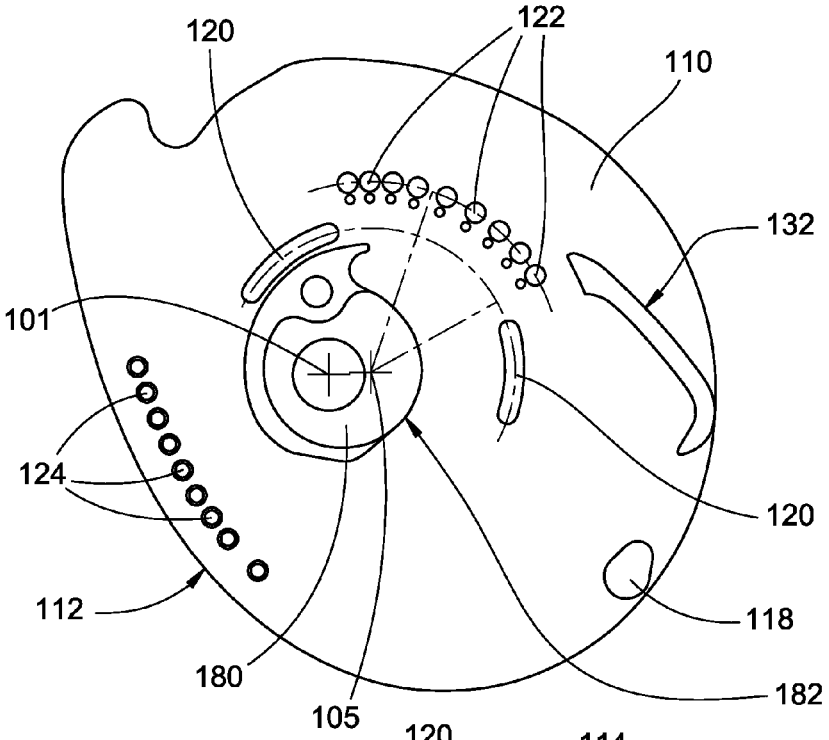
FIGS. 5A and 5B are schematic right and left side views, respectively, of a draw cable pulley member of an example inventive pulley assembly.
Figure 5B:
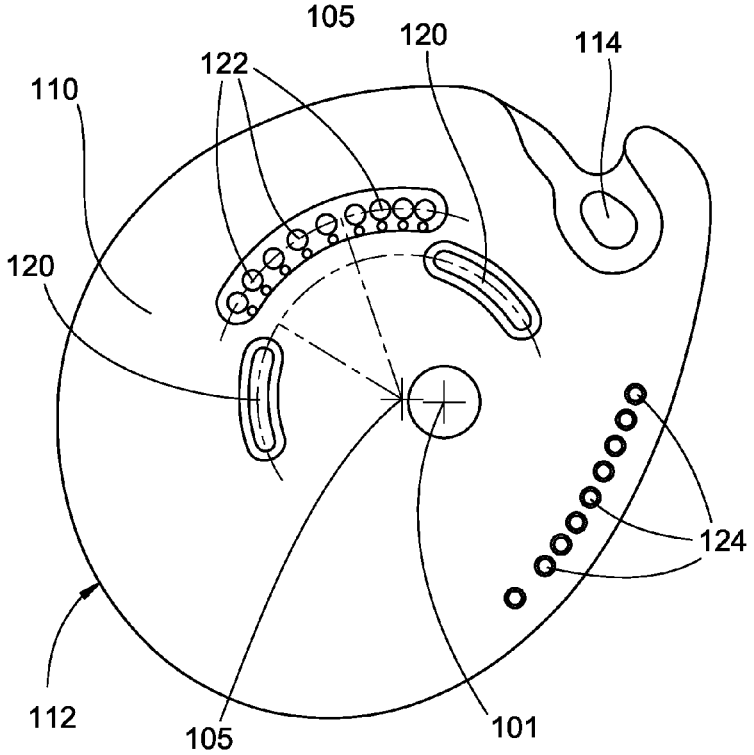

An example of an inventive pulley assembly 100 is shown in FIGS. 5A through 8B; the example shown is arranged for use in a binary cam bow (as in FIG. 2). As noted above, the pulley assembly 200 in a dual or hybrid cam bow can be substantially identical to or a substantial mirror image of the pulley assembly 100, and the following description can apply to both pulley assemblies 100 and 200 of such bows. The pulley assembly 100 comprises a draw cable pulley 110 (FIGS. 5A through 8B) and a reversible power cable module 150 (FIGS. 6A through 8B) substantially rigidly attached to the draw cable pulley 110. Each of those elements can be fabricated in any suitable way from any one or more suitably strong and rigid materials; such elements are commonly fabricated by machining from aluminum; other materials or fabrication methods can be employed within the scope of the present disclosure or appended claims. The draw cable pulley 110 typically (but not necessarily) includes one or (often) more cut-out portions to reduce the overall mass and moment of inertia of the pulley assembly 100. Such cut-out areas are omitted from the examples in the drawings so as not to unduly clutter the drawings, however, pulley assemblies that include such cut-out areas shall nevertheless fall within the scope of the present disclosure or appended claims.

The draw cable pulley 110 defines a first pulley assembly transverse rotation axis 101 and is mounted on the limb 11 in any suitable manner to rotate about the first pulley assembly axis 101. "Transverse" in the context of the present disclosure refers to a direction that is substantially perpendicular to a virtual plane in which the draw cable 30 moves as the bow is drawn (referred to as the "shooting plane"); the first pulley assembly axis 101 is substantially perpendicular to the shooting plane. Suitable mounting arrangements can include one or more of, e.g., an axle passing through the draw cable pulley 110, one or more axle segments integrally formed on the draw cable pulley 110, rotational bearings on the draw cable pulley 110 or on the limb 11, and so on; some examples are disclosed by co-owned U.S. Pat. Nos. 8,469,013 and 8,739,769, which are each incorporated by reference as if fully set forth herein.

The draw cable pulley 110 includes a circumferential draw cable journal or groove 112 arranged around at least a portion of its periphery. A first end of the draw cable 30 is secured to the draw cable pulley 110 in any suitable way (e.g., using draw cable anchor 114) and received in the draw cable journal 112. The draw cable pulley 110 lets out the first end of the draw cable 30 from the draw cable journal 112 when the bow is drawn and the draw cable pulley 110 rotates about the first pulley assembly axis 101. The draw cable pulley 110 can be eccentrically mounted (relative to the first pulley assembly axis 101) or non-circular so as to act as a cam as it lets out the draw cable 30. The example draw cable pulley 110 includes a power cable let-out pulley 180 having a circumferential power cable let-out groove or journal 182 (suitable for a binary cam bow; can be omitted for a dual cam bow). The power cable let-out pulley 180 can comprise a separate member substantially rigidly attached to the draw cable pulley 110 or can be integrally formed with the draw cable pulley 110. A second end of the second power cable 32 is secured to the power cable let-out pulley 180 in any suitable way and received in the draw cable let-out journal 182. The power cable let-out pulley 180 lets out the second end of the second power cable 32 from the power cable let-out journal 182 when the bow is drawn and the draw cable pulley 110 rotates about the first pulley assembly axis 101. The power cable let-out pulley 180 can be eccentrically mounted (relative to the first pulley assembly axis 101) or non-circular so as to act as a cam as it lets out the second power cable 32.

One or both of the draw cable pulley 110 and the reversible power module 150 are structurally arranged so as to enable substantially rigid attachment of the power module 150 to the draw cable pulley 110 in any one of one or more power module positions. The attachment of the draw cable pulley 110 and the power module 150 can be achieved in any suitable way. In the example in the drawings, two curved slots 120 are formed in the draw cable pulley 110, and a set of threaded holes 160 are formed in the power module 150; other suitable numbers, shapes, or arrangements of slots 120 and corresponding holes 160 can be employed. Two screws (or another suitable number; not shown) are inserted through the slots 120 and into holes 160, and are tightened to substantially rigidly attach the power module 150 to the draw cable pulley 110. With the screws loosened, the power module 150 can be moved among multiple power module positions, and then secured in any selected one of those power module positions by tightening the screws. The combination of slots 120, threaded holes 160, and screws is only one example of attachment of the power module to the draw cable pulley 110; any other suitable structural arrangement for achieving substantially rigid attachment of the power module 150 to the draw cable pulley 110 in any one of one or more power module positions can be employed within the scope of the present disclosure or appended claims. For example, holes 160 can lack threads and threaded nuts can be employed to tighten screws in slot 120 and holes 160. In another example, a separate, intermediate mounting member (not visible in the drawings) can be employed for attaching the reversible power module 150 to the draw cable pulley 110 in any one of multiple power module positions. The mounting member can be substantially rigidly attached to the draw cable pulley 110 and the power module 150 can be substantially rigidly attached to the mounting member. Examples of arrangements that include a mounting member are disclosed, e.g., in co-owned application Ser. No. 14/318,640, which is incorporated by reference as if fully set forth herein.

In some examples, the slots 120 can be arranged so that the set of multiple power module positions is a continuous range of positions of the power module 150 on the draw cable pulley 110. In other examples, including the example shown in the drawings, the set of multiple mounting power module positions can comprise a set of discrete positions of the power module 150 on the draw cable pulley 110. In the example shown, the draw cable pulley 110 includes a set of alignment holes 122 and the power module 150 includes a set of corresponding threaded alignment holes 162 (i.e., two alignment holes 162*a*/162*b* in the example shown). Aligning one of the holes 122 with one of the threaded holes 162 defines one of multiple discrete power module positions; inserting a screw through the aligned hole 122 and threading it into the aligned threaded hole 162 constrains the power module 150 at a corresponding fixed position relative to the draw cable pulley 110. Any other suitable structural arrangement for defining a set of discrete power module positions relative to the draw cable pulley 110 can be employed within the scope of the present disclosure or appended claims. For example, alignment holes 162 can lack threads and a threaded nut can be employed instead to secure the screw in the alignment holes 122/162. Other examples are shown in incorporated, co-owned application Ser. No. 14/318,640, in which a pin engages any one of a set of concave scallops.

The power cable module 150 has a circumferential power cable journal or groove 152 arranged around at least a portion of its periphery. The power cable module 150 is structurally arranged so as to act as a pulley, i.e., so as to receive a first end of the first power cable 31 in the circumferential power cable journal 152 and to take up the power cable 31 when the bow is drawn and the draw cable pulley 110 rotates about the first pulley assembly axis 101. The first end of the first power cable 31 is secured to the draw cable pulley 110 in any suitable way (e.g., using power cable anchor 118). The power cable pulley 150 typically is eccentrically mounted (relative to the first pulley assembly axis 101) or non-circular so as to act as a cam as it takes up the power cable 31. Some examples of suitable arrangements are disclosed in incorporated, co-owned application Ser. No. 14/318,640 and co-owned U.S. Pat. Nos. 7,305,979; 7,770,568; 8,181,638; 8,469,013; and 8,739,769. Each of those patents is incorporated by reference as if fully set forth herein. In the example shown, an additional power cable take-up journal 132 is formed on the draw cable journal 110. The power cable take-up journals 132 and 152 act together to form a composite power cable take-up pulley member. In other examples (not shown), the power cable 31 can wrap around a post or other structural member that, together with the power cable take-up journal 152, forms a composite power cable take-up pulley member. Pulley assemblies with or without an additional power cable take-up journal 132 or other such structural member shall fall within the scope of the present disclosure or appended claims.

Each different position of the power module 150 attached to the draw cable pulley 110 results in a corresponding dependence of the force exerted to draw the bow on to the distance the bow is drawn (i.e., the dependence of the draw force on the draw distance, also known as the draw force curve of the bow). The draw force curve can be characterized by, inter alia, a draw weight (i.e., the maximum force required during the draw), a draw length (i.e., a draw distance at which the draw force more or less abruptly reaches a local minimum draw force, referred to as let-off of the draw force), and an amount of stored energy of the drawn bow (i.e., the area under the draw force curve). Each different position of the power module 150 attached to the draw cable pulley 110 can result in one or more of: (i) a corresponding draw length of the bow that differs from a draw length resulting from at least one different power module position; (ii) a corresponding draw weight of the bow that differs from a draw weight resulting from at least one different power module position; (iii) corresponding stored energy of the drawn bow that differs from stored energy of the drawn bow resulting from at least one different power module position; or (iv) a corresponding draw force curve that differs from a draw force curve resulting from at least one different power module position.

Figure 6A:
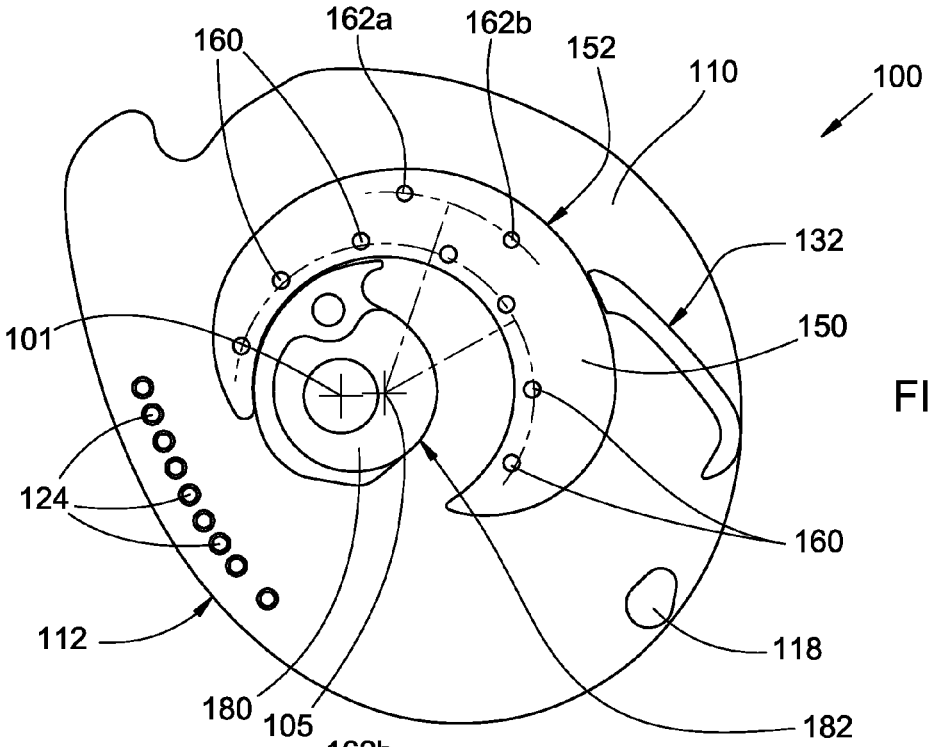
FIGS. 6A and 6B are schematic right side views of an example inventive pulley assembly in first and second example arrangements, respectively.
Figure 6B:
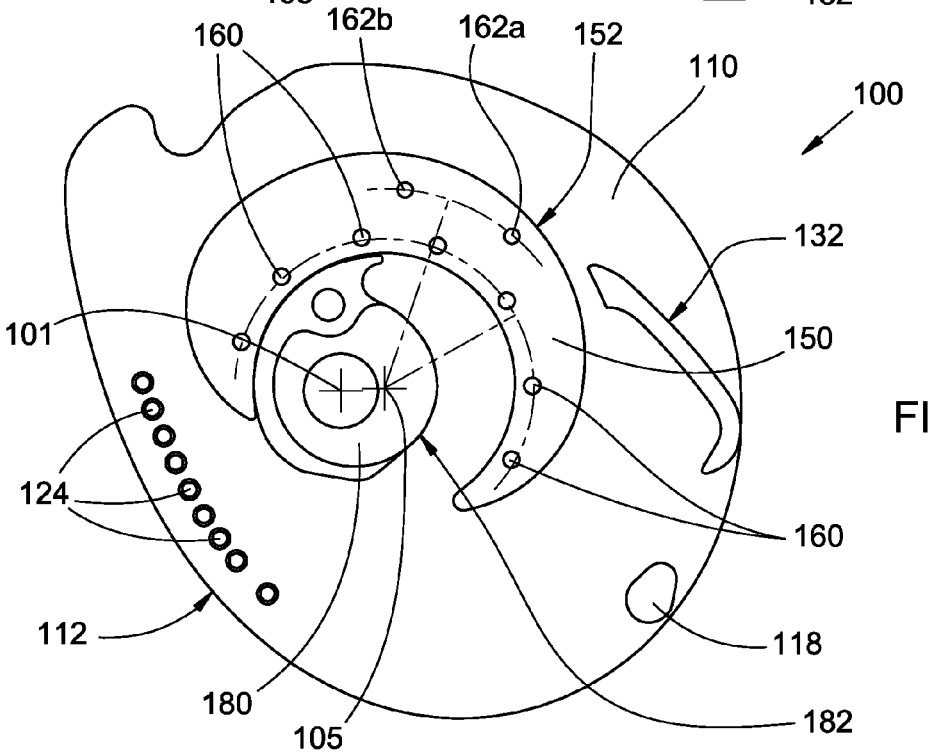
Figure 7A:
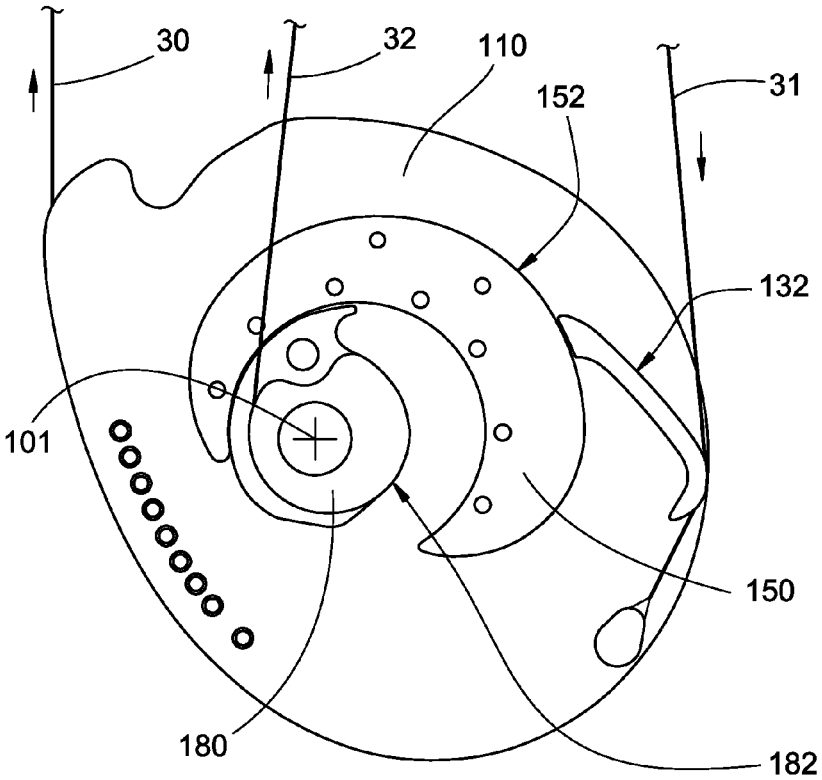
FIGS. 7A and 7B are schematic right side views of the example pulley assembly, arranged as in FIG. 6A, at brace and at full draw, respectively.
Figure 7B:
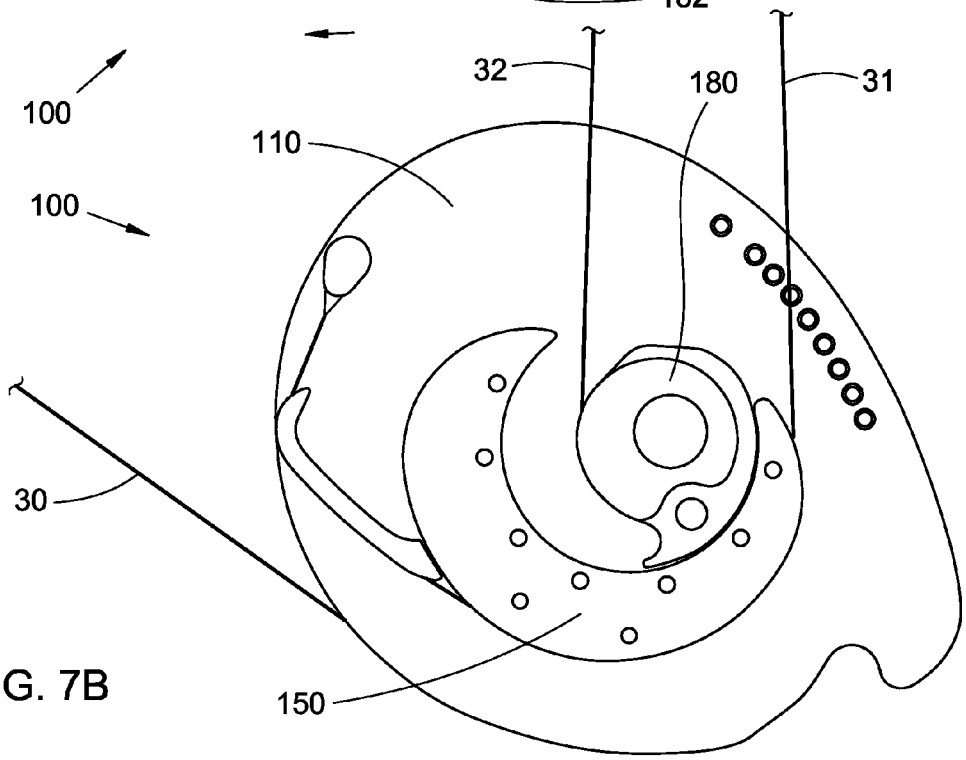
Figure 8A:
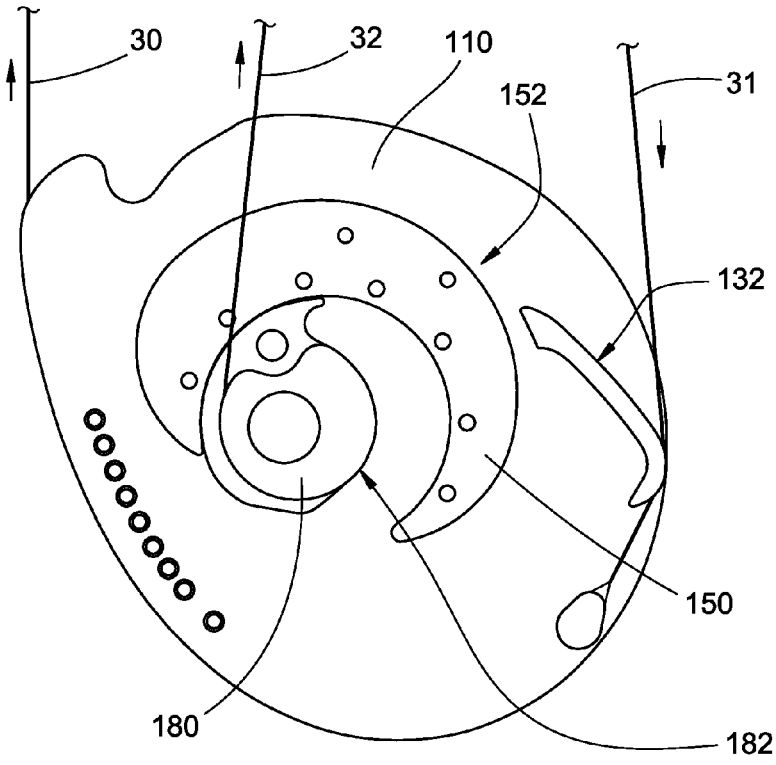
FIGS. 8A and 8B are schematic right side views of the example pulley assembly, arranged as in FIG. 6B, at brace and at full draw, respectively.
Figure 8B:
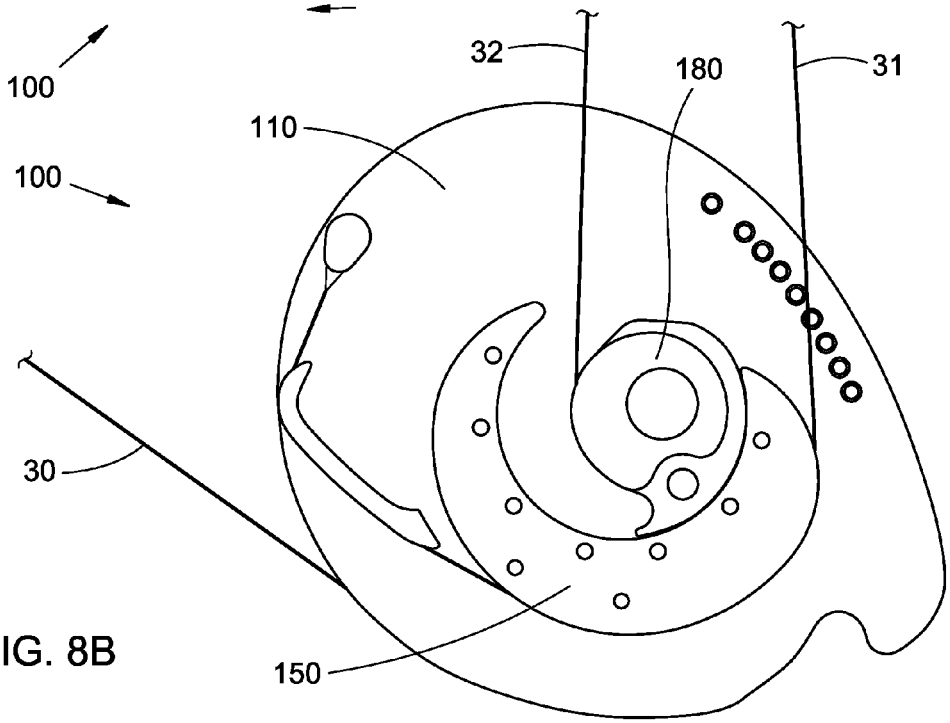
Figure 10A:
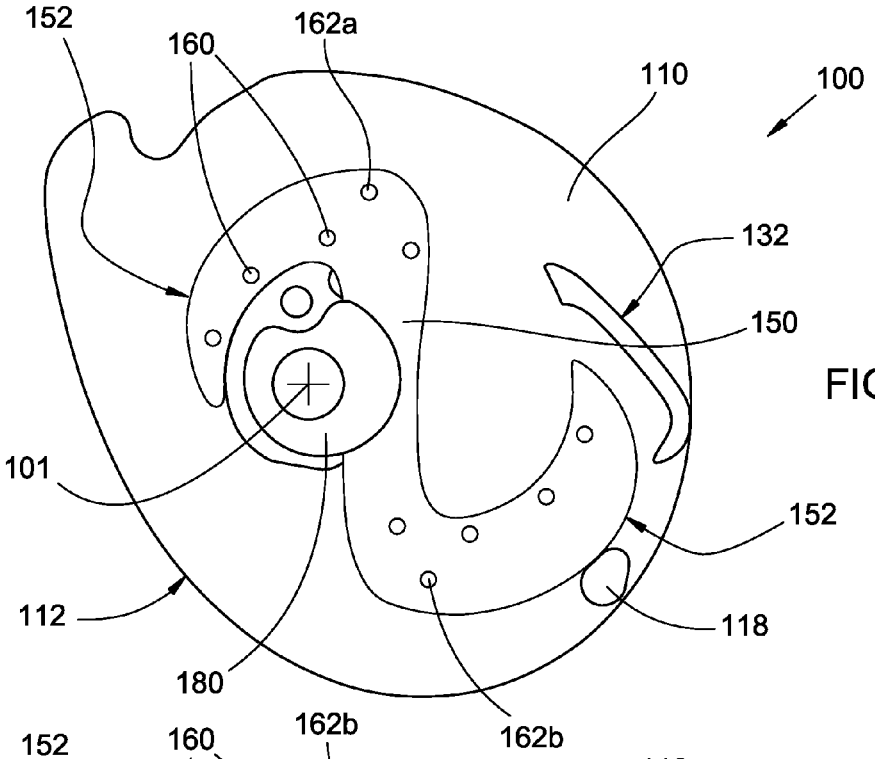
FIGS. 10A and 10B are schematic right side views of another example inventive pulley assembly in first and second example arrangements, respectively.
Figure 10B:
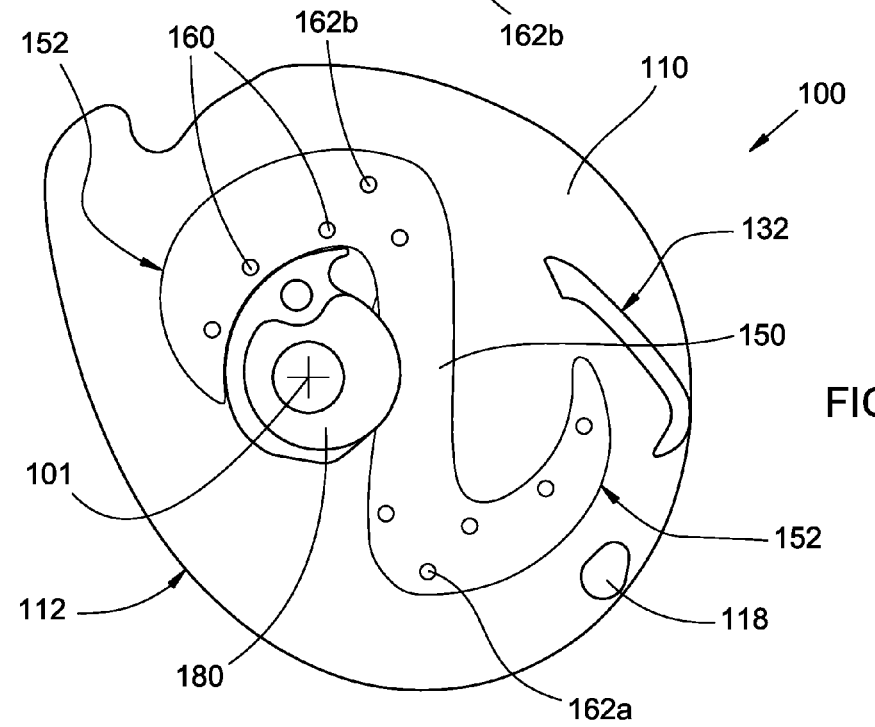

The power cable module 150 is reversible, i.e., it can be mounted with either face against the draw cable pulley 110 (by rotation about an axis substantially parallel to the shooting plane; e.g., FIGS. 6A, 7A, and 7B versus FIGS. 6B, 8A, and 8B) or it can be rotated between two discrete orientations while keeping the same face against the draw cable pulley (by rotation about an axis substantially perpendicular to the shooting plane; e.g., FIG. 10A versus FIG. 10B). In either case (different faces or same face against the draw cable pulley 110), the power cable 31 is taken up by different portions of the circumferential journal 152 with the power module 150 in the two alternate orientations, resulting in correspondingly altered dependence of the draw force on draw distance. First and second reversible mountings of the power module 150 on the draw cable pulley 110 are shown in FIGS. 6A and 6B, respectively, in which different faces of the power module 150 are against the draw cable pulley 110. The circumferential power cable take-up journal 152 of the power module 150 is shaped asymmetrically so that reversing the mounting of the power module 150 on the draw cable pulley 110 alters the effective lever arm of the power cable take-up journal 152 over at least a portion of the rotation of the pulley assembly 110, thereby also altering the bow's draw force curve. However, the reversible power module 150 is structurally arranged so that switching the orientation of the power module 150 alters the draw force curve (and hence the energy storage of the bow) without substantially altering the draw length and without substantially altering the draw weight. In contrast, reversing the mounting of a conventional reversible power module (e.g., as disclosed in U.S. Pat. No. 7,721,721) results in alteration of the draw length or draw weight of the bow. The inventive reversible power module 150 disclosed herein provides the novel capability of altering, by reversing the power module, the draw force curve and energy storage of the bow without substantially altering the draw length of the bow and without substantially altering the draw weight of the bow.

The asymmetrical shape of the power module 150 is arranged so that in both of the first and second reversible mountings, corresponding power module positions can be selected that result in (i) differing draw force curves; (ii) peak of the draw force (i.e., draw weight) remaining substantially unchanged; and (iii) let-off of the draw force at substantially the same rotational position of the pulley assembly 100 (i.e., at the same draw distance, thereby leaving the draw length of the bow substantially unchanged). The alteration of the draw force curve without changing the draw length or the draw weight necessarily results in an alteration of the energy stored by the bow when it is drawn. Any suitable structural arrangement of the power module 150 that provides that result (i.e., altered draw force curve, substantially unaltered draw length, and substantially unaltered draw weight, by reversing the orientation of the power module 150) can be employed within the scope of the present disclosure or appended claims. The following description applies to the specific example shown in the drawings, and is not intended to limit the overall scope of the present disclosure or appended claims.

Figure 9:
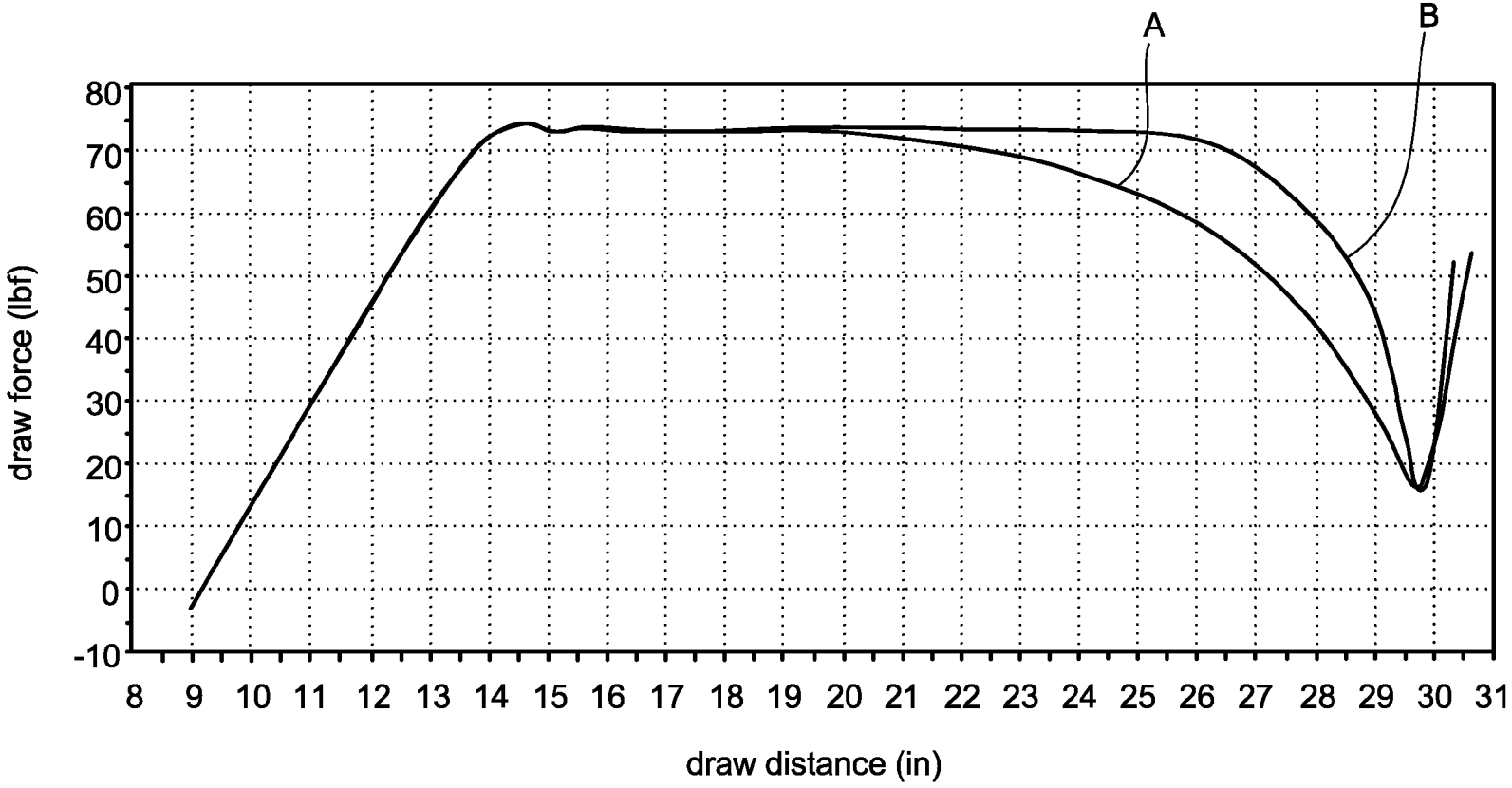
FIG. 9 shows plots of draw force versus draw distance (i.e., draw force curves) for a binary cam bow with pulley assemblies arranged: (i) as in FIGS. 6A, 7A, and 7B; and (ii) as in FIGS. 6B, 8A, and 8B.

In the example shown, two threaded alignment holes 162*a*/162*b* are provided on the power module 150. As described above, in the first reversible mounting (i.e., a first power module orientation) a first alignment hole 162*a* can be aligned with a selected one of the alignment holes 122 on the draw cable pulley 110, and a screw inserted through the aligned holes 122/162*a* fixes the position of the power module 150 on the draw cable pulley 110 (as in FIG. 6A). With the pulley assembly 100 in the arrangement of FIG. 6A the bow has corresponding first draw force curve, stored energy, and draw length (curve A of FIG. 9). The power module 150 can be removed, turned over, and remounted in the second reversible mounting (i.e., a second, or the "other", power module orientation) with a second alignment hole 162*b* aligned with the same alignment hole 122 on the draw cable pulley 110 to fix the position of the power module 150 on the draw cable pulley 110 (as in FIG. 6B). With the pulley assembly 100 in the arrangement of FIG. 6B the bow has corresponding second draw force curve, stored energy, and draw length (curve B of FIG. 9). The positions of the two alignment holes 162*a*/162*b* on the power module 150 and the circumferential profile of the power cable take-up journal 152 are arranged so that the first draw force curve differs from the second draw force curve and the first stored energy differs from the second stored energy, while the first draw length is substantially equal to the second draw length and the first draw weight is substantially equal to the second draw weight. A similar result can be achieved using a single alignment hole of the power module 150 and two suitably positioned corresponding alignment holes (one for each of the two power module orientations) on the draw cable pulley 110.

The pulley assembly 100 arranged according to FIG. 6A (referred to as the "low-energy" mounting of the power module 150, for reasons explained below) is shown at brace and at full draw in FIGS. 7A and 7B, respectively; the pulley assembly 100 arranged according to FIG. 6B (referred to as the "high-energy" mounting of the power module 150, as explained below) is shown at brace and at full draw in FIGS. 8A and 8B, respectively. The angle of rotation of the pulley assembly 100, and hence the draw length, is substantially the same for both of the orientations of the power module 150 on the draw cable pulley 110 (i.e., for both low-energy and high-energy orientations of the power module 150). The draw force curves, and hence the energy storage, differs between the two reversible orientations of the power module 150 on the draw cable pulley 110. The low-energy mounting (FIG. 6A) exhibits a smaller effective lever arm of the power cable take-up journal 152 over a later portion of the draw distance, correspondingly lower draw force later in the draw, and lower stored energy at full draw compared to the high-energy mounting (FIG. 6B), hence the "low-energy" and "high-energy" designations. The difference in draw force can be seen in the right-hand portions of the draw force curves of FIG. 9 (curve A for the low-energy mounting as in FIG. 6A; curve B for the high-energy mounting as in FIG. 6B).

In the example shown, the left-hand portions of the two draw force curves are substantially identical, because take-up of the power cable 31 by the additional power cable take-up journal 132 (and hence the draw force) during the earlier portion of the draw is unaffected by the reversible mounting of the power module 150. This need not be the case, however. The draw cable pulley 110 and the power module 150 can be arranged so that the corresponding draw force curves of the two reversible mountings of the power module 150 differ over any desired one or more portions of the draw distance, or over the entire draw distance, while having substantially the same draw length and draw weight. Any such arrangement shall fall within the scope of the present disclosure or appended claims.

As noted above, any suitable arrangement of the holes 160 and 162 on the power module 150, and slots 120 and holes 122 on the draw cable pulley, can be employed within the scope of the present disclosure or appended claims to achieve the desired alteration of draw force curve and draw energy upon reversing the power module 150 while maintaining a substantially constant draw length and draw weight. In the example shown, the multiple holes 160 on the power module 150 are arranged along a circular arc; the slots 120 on the draw cable pulley 110 are arranged along a circular arc of the same radius. With the power module 150 mounted on the draw cable pulley 110 in either reversible mounting, the centers of those circular arcs coincide at axis 105 (arcs shown as center lines in FIGS. 5A, 5B, 6A, and 6B). Axis 105 is displaced from the pulley assembly axis 101 in this example, but axes 101 and 105 can coincide in other examples within the scope of the present disclosure or appended claims. The alignment holes 162 on the power module 150 are arranged along a circular arc; the alignment holes 122 on the draw cable pulley 110 are arranged along a circular arc of the same radius (typically, but not necessarily, a radius different than that of the arcs of holes 160 and slots 120; shown as center lines in FIGS. 5A, 5B, 6A, and 6B). With the power module 150 mounted on the draw cable pulley 110 in either reversible mounting, the centers of those circular arcs (for the alignment holes 122/162) also coincide at axis 105, like the arcs for the holes 160 and slots 120. The peripheral power cable take-up journal 152 varies in its distance from the axis 101, thereby providing the differing effective lever arm for taking up the power cable 31 as the bow is drawn with the power module 150 in its respective reversed mountings on the draw cable pulley 110.

The example arrangements of FIGS. 10A and 10B show "low-energy" and "high-energy" mountings, respectively, of a power module 150 arranged so that in its two different orientations the same face of the power module remains against the draw cable pulley 110. As in the example shown in FIGS. 6A through 8B, the different orientations result in different portions of the power cable groove 152 engaging the power cable 31 as the bow is drawn, altering the draw force curve and the energy storage without also altering the draw weight or the draw length.

A first method for adjusting the pulley assembly 100 comprises: removing the power module 150 from a first one of the power module positions and a first one of the two power module orientations on the draw cable pulley 110; and reattaching the power module 150 to the draw cable pulley 110 in the first one of the power module positions and in the other one of the two power module orientations, thereby altering the stored energy of the drawn bow without substantially altering the draw length of the bow and without substantially altering the draw weight of the bow. A second method for adjusting the pulley assembly 100 comprises: removing the power module 150 from a first one of the power module positions and a first one of the two power module orientations on the draw cable pulley 110; and reattaching the power module 150 to the draw cable pulley 110 in a different one of the power module positions and in one of the two power module orientations, thereby altering the draw length of the bow or the draw weight of the bow.

In certain examples, there is only one power module position and therefore only one corresponding draw weight and one corresponding draw length. The power module can nevertheless be structurally arranged according to the present disclosure to permit attachment to the draw cable pulley in one of the two power module orientations to provide differing stored energy without substantially altering the draw weight or draw length.

The pulley assembly 100 can further comprise a rotation stop substantially rigidly attached to the draw cable pulley 110. The rotation stop can be substantially rigidly attached to the draw cable pulley 110 in any one of a set of multiple rotation stop positions. In the example shown the rotation stop can comprise a rigid post (typically cushioned or damped) attached to the draw cable pulley 110 (e.g., positioned in a selected one of the holes 124 on the draw cable pulley 110) so that it impedes further rotation of the pulley assembly 100 when the post comes into contact with the power cable 31. Other suitable mechanical arrangements for implementing a rotation stop (e.g., a post arranged to collide with the bow limb 11) can be employed within the scope of the present disclosure or appended claims. Each rotation stop position (e.g., each one of the holes 124) corresponds to the draw length resulting from a corresponding position of the power module 150 on the draw cable pulley 110. A method for adjusting the pulley assembly 100 therefore comprises, after securing the power module 150 to the draw cable pulley 110 at a selected position and in a selected one of the two power module orientations to select the draw length of the bow, substantially rigidly attaching the rotation stop to the draw cable pulley 110 in a corresponding one of the multiple rotation stop positions that corresponds to the selected draw length.

In examples wherein the power module 150 can be moved only among sets of discrete positions, the set of multiple rotation stop positions also can comprise a set of discrete positions. In the examples shown, multiple threaded holes 124 formed in the draw cable pulley 110 are positioned at each desired rotation stop position. Each one of the discrete positions of the power module 150 (corresponding to a corresponding one of the holes 122 aligned with one of the holes 162*a*/162*b*) corresponds to one of the discrete rotation stop positions. In the examples shown, nine holes 122 and nine holes 124 correspond to nine discrete positions of the power module 150 on the draw cable pulley 110 and nine corresponding draw lengths of the bow.

As noted above, the disclosed inventive pulley assemblies can be employed with any type of compound archery bow, including dual cam, binary cam, solo cam, and hybrid cam bows. In dual or binary cam bows (FIGS. 1 and 2, respectively), the second pulley assembly 200 (rotatably mounted on limb 12) typically is substantially identical to or a substantial mirror image of the first pulley assembly 100 already described. The power cable 32 is taken up by the power cable take-up journal of the second pulley assembly 200 as the bow is drawn and the second pulley assembly 200 rotates about a corresponding second pulley assembly axis. The power module of the second pulley assembly 200 can be adjusted in the same ways and with the same effect as disclosed above for the first pulley assembly 100. If the bow is a binary cam bow (FIG. 2), the pulley assemblies 100 and 200 each can resemble, e.g., the example of FIGS. 2, and 5A through 8B. If the bow is a dual cam bow (FIG. 1), the power cable let-out member 180 can be omitted and the power cables 31/32 can be attached (directly or indirectly) to the corresponding bow limbs.

Figure 11:
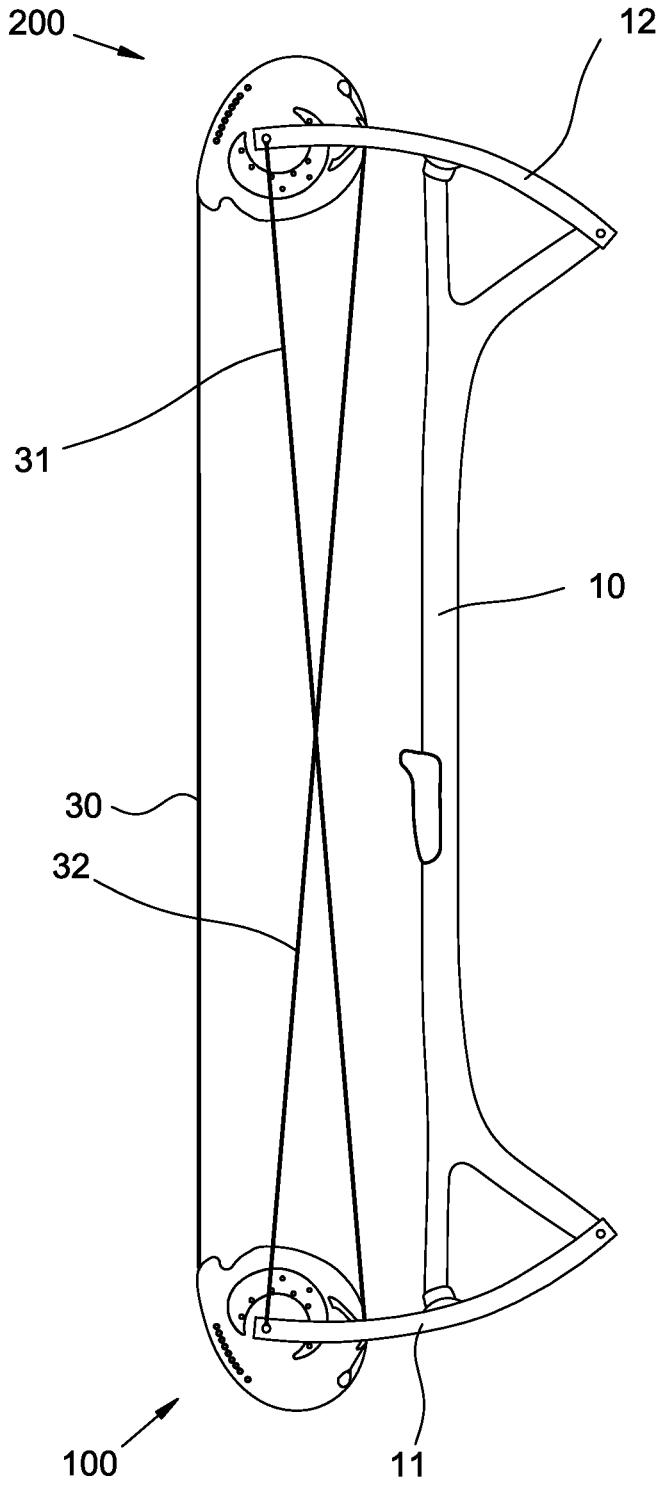
FIG. 11 illustrates schematically the example dual cam archery bow of FIG. 1 with the power modules interchanged between the upper and lower pulley assemblies.

In a dual cam or binary cam bow, an alternative arrangement can be employed for reversing the power modules. In such bows, the first and second pulley assemblies are substantially identical or substantial mirror images of one another. In particular, the respective power modules are substantially identical or substantial mirror images. To reverse the power modules (i.e., to alter the draw force curve without substantially altering the draw length or draw weight), the power modules of the two pulley assemblies can be swapped, with results similar to, e.g., those shown in FIGS. 6A through 8B. FIGS. 1 and 11 illustrate schematically an example of a dual cam archery bow with the power modules in a "low-energy" arrangement (as in FIG. 6A) in FIG. 1, and with the power modules swapped between the two pulley assemblies to result in the "high-energy" arrangement (as in FIG. 6B) in FIG. 11. All of the structural arrangements or additional features disclosed herein (e.g., screws/holes/slots, rotation stop, and so forth) can be employed in combination with the "swapped" power modules.

If the bow is a solo cam bow (FIG. 3) or a hybrid cam bow (FIG. 4), the pulley assembly 100 can further include a let-out pulley 190 substantially rigidly coupled to the draw cable pulley 110 or the power module 150; the power cable let-out member 180 can be omitted. The let-out pulley 190 is structurally arranged to receive a second end of the draw cable 30 (in a solo cam bow) or the additional coupling cable 33 (in a hybrid cam bow) in a circumferential draw cable journal and let out the draw cable 30 or the coupling cable 33.

Some examples of arrangements suitable for dual, binary, solo, or hybrid cam bows are disclosed in U.S. Pat. Nos. 7,305,979; 7,770,568; 8,181,638; 8,469,013; and 8,739,769. Each of those patents is incorporated by reference as if fully set forth herein.

In addition to the preceding, the following examples fall within the scope of the present disclosure or appended claims:

EXAMPLE 1

A first pulley assembly for a compound archery bow, the first pulley assembly comprising a draw cable pulley and a power module substantially rigidly attached to the draw cable pulley, wherein: (a) the draw cable pulley is structurally arranged so as to (i) define a first pulley assembly transverse rotation axis, (ii) be mounted on a first limb of an archery bow to rotate about the first pulley assembly axis, (iii) receive a first end of a draw cable of the bow in a circumferential draw cable journal of the draw cable pulley, and (iv) let out the first end of the draw cable when the bow is drawn and the draw cable pulley rotates about the first pulley assembly axis; (b) one or both of the draw cable pulley and the power module are structurally arranged so as to enable substantially rigid attachment of the power module to the draw cable pulley in any one of one or more power module positions and, for each power module position, in any one of two power module orientations; (c) the power module is structurally arranged so as to (i) receive a power cable of the bow in a circumferential power cable journal of the power module, and (ii) take up the power cable when the bow is drawn and the draw cable pulley rotates about the first pulley assembly axis; and (d) each one of the one or more power module positions results in a corresponding draw length of the bow and a corresponding draw weight of the bow; (e) for each one of the one or more power module positions, the two power module orientations result in substantially the same draw length of the bow and substantially the same draw weight of the bow; and (f) for each one of the one or more power module positions, the two power module orientations result in differing stored energies of the drawn bow.

EXAMPLE 2

The pulley assembly of Example 1 further comprising a mounting member, wherein (i) one or both of the mounting member and the draw cable pulley are structurally arranged so as to enable substantially rigid attachment of the mounting member to the draw cable pulley in any one of multiple mounting member positions, (ii) one or both of the mounting member and the power module are structurally arranged so as to enable substantially rigid attachment of the power module to the mounting member in any one of the one or more power module positions, and (iii) attachment of the power module to the mounting member and attachment of the mounting member to the power cable pulley provides the substantially rigid attachment of the power module to the draw cable pulley.

EXAMPLE 3

The pulley assembly of any one of Examples 1 or 2 wherein the two power module orientations differ by rotation of the power module about an axis substantially perpendicular to the first pulley rotation axis and by opposing faces of the power module being positioned against the draw cable pulley.

EXAMPLE 4

The pulley assembly of any one of Examples 1 or 2 wherein the two power module orientations differ by rotation of the power module about an axis substantially parallel to the first pulley rotation axis with the same face of the power module remaining positioned against the draw cable pulley.

EXAMPLE 5

The pulley assembly of any one of Examples 1-4 wherein the pulley assembly further comprises a cable let-out pulley substantially rigidly attached to the draw cable pulley or the power module, wherein the cable let-out pulley is structurally arranged so as to (i) receive an additional cable of the bow in a circumferential cable journal of the cable let-out pulley, and (ii) let out the additional cable when the bow is drawn and the draw cable pulley rotates about the first pulley assembly axis.

EXAMPLE 6

The pulley assembly of any one of Examples 1-5 further comprising a second pulley assembly for the compound archery bow, the second pulley assembly comprising a second draw cable pulley and a second power module substantially rigidly attached to the second draw cable pulley, wherein: (a') the second draw cable pulley is structurally arranged so as to (i) define a second pulley assembly transverse rotation axis substantially parallel to the first pulley assembly axis, (ii) be mounted on a second limb of the archery bow to rotate about the second pulley assembly axis, (iii) receive a second end of the draw cable of the bow in a circumferential draw cable journal of the second draw cable pulley, and (iv) let out the second end of the draw cable when the bow is drawn and the second draw cable pulley rotates about the second pulley assembly axis; (b') one or both of the second draw cable pulley and the second power module are structurally arranged so as to enable substantially rigid attachment of the second power module to the second draw cable pulley in any one of one or more second power module positions and, for each second power module position, in any one of two second power module orientations; (c') the second power module is structurally arranged so as to (i) receive a second power cable of the bow in a circumferential power cable journal of the second power module, and (ii) take up the second power cable when the bow is drawn and the second draw cable pulley rotates about the second pulley assembly axis; (d') each one of the one or more second power module positions results in a corresponding draw length of the bow and a corresponding draw weight of the bow; (e') for each one of the one or more second power module positions, the two second power module orientations result in substantially the same draw length of the bow and substantially the same draw weight of the bow; and (f') for each one of the one or more second power module positions, the two second power module orientations result in differing stored energies of the drawn bow.

EXAMPLE 7

The pulley assembly of any one of Examples 1-6 wherein: (b') one or both of the draw cable pulley and the power module are structurally arranged so as to enable substantially rigid attachment of the power module to the draw cable pulley in any one of multiple power module positions; and (d') each one of the one or more power module positions results in (i) a corresponding draw length of the bow that differs from draw lengths corresponding to other power module positions, or (ii) a corresponding draw weight of the bow that differs from draw weights corresponding to other power module positions.

EXAMPLE 8

The pulley assembly of Example 7 wherein the multiple power module positions comprise a set of discrete positions of the power module on the draw cable pulley.

EXAMPLE 9

The pulley assembly of Example 8 wherein one or both of the draw cable pulley and the power module are structurally arranged to engage each other, in both of the two power module orientations, to mechanically index each one of the discrete positions of the power module on the draw cable pulley.

EXAMPLE 10

The pulley assembly of any one of Examples 7-9 further comprising a rotation stop substantially rigidly attached to the draw cable pulley, wherein one or both of the draw cable pulley and the rotation stop are structurally arranged so as to enable substantially rigid attachment of the rotation stop to the draw cable pulley in any one of multiple rotation stop positions corresponding to the draw lengths resulting from the multiple power module positions.

EXAMPLE 11

The pulley assembly of Example 10 wherein: the multiple power module positions comprise a set of discrete positions of the power module on the draw cable pulley; the multiple rotation stop positions comprise a set of discrete positions; and each one of the discrete rotation stop positions corresponds to one of the discrete power module positions.

EXAMPLE 12

A method for adjusting the pulley assembly of any one of Examples 10 or 11, the method comprising: (A) removing the power module from a first one of the multiple power module positions and a first one of the two power module orientations on the draw cable pulley; and (B) reattaching the power module to the draw cable pulley in a different one of the multiple power module positions and in one of the two power module orientations, thereby altering the draw length of the bow, (C) wherein the method further comprises moving the rotation stop from a first one of the multiple rotation stop positions and substantially rigidly attaching the rotation stop to the draw cable pulley in a second, different one of the multiple rotation stop positions that corresponds to the altered draw length.

EXAMPLE 13

A method for adjusting the pulley assembly of any one of Examples 7-11, the method comprising: (A) removing the power module from a first one of the multiple power module positions and a first one of the two power module orientations on the draw cable pulley; and (B) reattaching the power module to the draw cable pulley in a different one of the multiple power module positions and in one of the two power module orientations, thereby altering the draw length of the bow or the draw weight of the bow.

EXAMPLE 14

A method for adjusting the pulley assembly of any one of Examples 1-11, the method comprising: (A) removing the power module from a first one of the one or more power module positions and a first one of the two power module orientations on the draw cable pulley; and (B) reattaching the power module to the draw cable pulley in the first one of the one or more power module positions and in the other one of the two power module orientations, (C) thereby altering the stored energy of the drawn bow without substantially altering the draw length of the bow and without substantially altering the draw weight of the bow.

EXAMPLE 15

A compound archery bow, comprising: (a) a central riser; (b) first and second bow limbs secured to opposing ends of the riser; (c) a first pulley assembly rotatably mounted on the first bow limb; (d) either an idler wheel or a second pulley assembly rotatably mounted on the second bow limb; (e) a draw cable; and (f) a power cable, wherein: (g) the first pulley assembly comprises a draw cable pulley and a power module substantially rigidly attached to the draw cable pulley; (h) the draw cable pulley is structurally arranged so as to (i) define a first pulley assembly transverse rotation axis, (ii) be mounted on the first limb of the bow to rotate about the first pulley assembly axis, (iii) receive a first end of the draw cable in a circumferential draw cable journal of the draw cable pulley, and (iv) let out the first end of the draw cable when the bow is drawn and the draw cable pulley rotates about the first pulley assembly axis; (i) one or both of the draw cable pulley and the power module are structurally arranged so as to enable substantially rigid attachment of the power module to the draw cable pulley in any one of one or more power module positions and, for each power module position, in any one of two power module orientations; (j) the power module is structurally arranged so as to (i) receive the power cable in a circumferential power cable journal of the power module, and (ii) take up the power cable when the bow is drawn and the draw cable pulley rotates about the first pulley assembly axis; and (k) each one of the one or more power module positions results in a corresponding draw length of the bow and a corresponding draw weight of the bow; (l) for each one of the one or more power module positions, the two power module orientations result in substantially the same draw length of the bow and substantially the same draw weight of the bow; and (m) for each one of the one or more power module positions, the two power module orientations result in differing stored energies of the drawn bow.

EXAMPLE 16

The bow of Example 15 wherein (i) the first pulley assembly further comprises a mounting member, (i) one or both of the mounting member and the draw cable pulley are structurally arranged so as to enable substantially rigid attachment of the mounting member to the draw cable pulley in any one of multiple mounting member positions, (ii) one or both of the mounting member and the power module are structurally arranged so as to enable substantially rigid attachment of the power module to the mounting member in any one of the one or more power module positions, and (iii) attachment of the power module to the mounting member and attachment of the mounting member to the power cable pulley provides the substantially rigid attachment of the power module to the draw cable pulley.

EXAMPLE 17

The bow of any one of Examples 15 or 16 wherein the two power module orientations differ by rotation of the power module about an axis substantially perpendicular to the first pulley rotation axis and by opposing faces of the power module being positioned against the draw cable pulley.

EXAMPLE 18

The bow of any one of Examples 15 or 16 wherein the two power module orientations differ by rotation of the power module about an axis substantially parallel to the first pulley rotation axis with the same face of the power module remaining positioned against the draw cable pulley.

EXAMPLE 19

The bow of any one of Examples 15-18 further comprising the second pulley assembly, wherein the second pulley assembly includes a power cable let-out pulley that is structurally arranged so as to (i) receive the power cable in a circumferential power cable journal of the power cable let-out pulley, and (ii) let out the second power cable when the bow is drawn and the draw cable pulley rotates about the first pulley assembly axis.

EXAMPLE 20

The bow of any one of Examples 15-18 further comprising the second pulley assembly and a second power cable, wherein: (g') the second pulley assembly comprises a second draw cable pulley and a second power module substantially rigidly attached to the second draw cable pulley; (h') the second draw cable pulley is structurally arranged so as to (i) define a second pulley assembly transverse rotation axis substantially parallel to the first pulley assembly axis, (ii) be mounted on the second limb of the bow to rotate about the second pulley assembly axis, (iii) receive a second end of the draw cable in a circumferential draw cable journal of the second draw cable pulley, and (iv) let out the second end of the draw cable when the bow is drawn and the second draw cable pulley rotates about the second pulley assembly axis; (i') one or both of the second draw cable pulley and the second power module are structurally arranged so as to enable substantially rigid attachment of the second power module to the second draw cable pulley in any one of one or more second power module positions and, for each second power module position, in any one of two second power module orientations; (j') the second power module is structurally arranged so as to (i) receive a second power cable of the bow in a circumferential power cable journal of the second power module, and (ii) take up the second power cable when the bow is drawn and the second draw cable pulley rotates about the second pulley assembly axis; (k') each one of the one or more second power module positions results in a corresponding draw length of the bow and a corresponding draw weight of the bow; (l') for each one of the one or more second power module positions, the two second power module orientations result in substantially the same draw length of the bow and substantially the same draw weight of the bow; and (m') for each one of the one or more second power module positions, the two second power module orientations result in differing stored energies of the drawn bow.

EXAMPLE 21

The bow of Example 20 wherein: (n) the first pulley assembly further comprises a first power cable let-out pulley substantially rigidly attached to the draw cable pulley or the power module; (o) the first power cable let-out pulley is structurally arranged so as to (i) receive the second power cable of the bow in a circumferential power cable journal of the first power cable let-out pulley, and (ii) let out the second power cable when the bow is drawn and the draw cable pulley rotates about the first pulley assembly axis; (p) the second pulley assembly further comprises a second power cable let-out pulley substantially rigidly attached to the second draw cable pulley or the second power module; and (q) the second power cable let-out pulley is structurally arranged so as to (i) receive the first power cable of the bow in a circumferential power cable journal of the second power cable let-out pulley, and (ii) let out the first power cable when the bow is drawn and the second draw cable pulley rotates about the second pulley assembly axis.

EXAMPLE 22

The bow of Example 15-19 further comprising the idler wheel, wherein: (n) the first pulley assembly further comprises a draw cable let-out pulley substantially rigidly attached to the first draw cable pulley or the power module; and (o) the draw cable let-out pulley is structurally arranged so as to (i) receive a second end of the draw cable in a circumferential draw cable journal of the draw cable let-out pulley, and (ii) let out the second end of the draw cable, with the draw cable passing around the idler wheel, when the bow is drawn and the draw cable pulley rotates about the first pulley assembly axis.

EXAMPLE 23

The bow of Example 15-19 further comprising the second pulley assembly and a coupling cable, wherein: (n) the first pulley assembly further comprises a coupling cable let-out pulley substantially rigidly attached to the draw cable pulley or the power module; (o) the second pulley assembly comprises a second draw cable pulley and a coupling cable take-up pulley; (p) the second draw cable pulley is structurally arranged so as to (i) receive a second end of the draw cable in a circumferential draw cable journal of the second draw cable pulley, and (ii) let out the second end of the draw cable when the bow is drawn and the second pulley assembly rotates about the second pulley assembly axis; (q) the coupling cable take-up pulley is structurally arranged so as to (i) receive a first end of the coupling cable in a circumferential coupling cable journal of the coupling cable take-up pulley, and (ii) take up the first end of the coupling cable when the bow is drawn and the second pulley assembly rotates about the second pulley assembly axis; and (r) the coupling cable let-out pulley is structurally arranged so as to (i) receive a second end of the coupling cable in a circumferential coupling cable journal of the coupling cable let-out pulley, and (ii) let out the second end of the coupling cable when the bow is drawn and the first pulley assembly rotates about the first pulley assembly axis.

EXAMPLE 24

The bow of any one of Examples 15-23 wherein: (b') one or both of the draw cable pulley and the power module are structurally arranged so as to enable substantially rigid attachment of the power module to the draw cable pulley in any one of multiple power module positions; and (d') each one of the one or more power module positions results in (i) a corresponding draw length of the bow that differs from draw lengths corresponding to other power module positions, or (ii) a corresponding draw weight of the bow that differs from draw weights corresponding to other power module positions.

EXAMPLE 25

The bow of Example 24 wherein the multiple power module positions comprise a set of discrete positions of the power module on the draw cable pulley.

EXAMPLE 26

The bow of Example 25 wherein one or both of the draw cable pulley and the power module are structurally arranged to engage each other, in both of the two power module orientations, to mechanically index each one of the discrete positions of the power module on the draw cable pulley.

EXAMPLE 27

The bow of any one of Examples 24-26 further comprising a rotation stop substantially rigidly attached to the draw cable pulley, wherein one or both of the draw cable pulley and the rotation stop are structurally arranged so as to enable substantially rigid attachment of the rotation stop to the draw cable pulley in any one of multiple rotation stop positions corresponding to the draw lengths resulting from the multiple power module positions.

EXAMPLE 28

The bow of Example 27 wherein: the multiple power module positions comprise a set of discrete positions of the power module on the draw cable pulley; the multiple rotation stop positions comprise a set of discrete positions; and each one of the discrete rotation stop positions corresponds to one of the discrete power module positions.

EXAMPLE 29

A method for adjusting the bow of any one of Examples 27 or 28, the method comprising: (A) removing the power module from a first one of the multiple power module positions and a first one of the two power module orientations on the draw cable pulley; and (B) reattaching the power module to the draw cable pulley in a different one of the multiple power module positions and in one of the two power module orientations, thereby altering the draw length of the bow, (C) wherein the method further comprises moving the rotation stop from a first one of the multiple rotation stop positions and substantially rigidly attaching the rotation stop to the draw cable pulley in a second, different one of the multiple rotation stop positions that corresponds to the altered draw length.

EXAMPLE 30

A method for adjusting the bow of any one of Examples 24-28, the method comprising: (A) removing the power module from a first one of the multiple power module positions and a first one of the two power module orientations on the draw cable pulley; and (B) reattaching the power module to the draw cable pulley in a different one of the multiple power module positions and in one of the two power module orientations, thereby altering the draw length of the bow or the draw weight of the bow.

EXAMPLE 31

A method for adjusting the bow of any one of Examples 15-28, the method comprising: (A) removing the power module from a first one of the one or more power module positions and a first one of the two power module orientations on the draw cable pulley; and (B) reattaching the power module to the draw cable pulley in the first one of the one or more power module positions and in the other one of the two power module orientations, (C) thereby altering the stored energy of the drawn bow without substantially altering the draw length of the bow and without substantially altering the draw weight of the bow.

EXAMPLE 32

A compound archery bow, comprising: (a) a central riser; (b) first and second bow limbs secured to opposing ends of the riser; (c) a first draw cable pulley rotatably mounted on the first bow limb; (d) a second draw cable pulley rotatably mounted on the second bow limb; (e) first and second power modules; and (f) a draw cable and two power cables, wherein: (g) each one of the first and second draw cable pulleys is structurally arranged so as to (i) define a corresponding pulley assembly transverse rotation axis, (ii) be mounted on the corresponding limb of the bow to rotate about the corresponding pulley assembly axis, (iii) receive a corresponding end of the draw cable in a corresponding circumferential draw cable journal, and (iv) let out the corresponding end of the draw cable when the bow is drawn and the first and second draw cable pulleys rotate about the corresponding pulley assembly axes; (h) the first and second draw cable pulleys, the first and second power modules, or both are structurally arranged so as to enable (i) substantially rigid attachment of one of the first or second power modules to the first draw cable pulley in any one of one or more first pulley assembly power module positions and (ii) substantially rigid attachment of the other of the first or second power modules to the second draw cable pulley in a corresponding one of one or more second pulley assembly power module positions; (i) each one of the first and second power modules is structurally arranged, when substantially rigidly attached to a corresponding one of the first and second draw cable pulleys, so as to (i) receive a corresponding one of the power cables in a circumferential power cable journal of that power module, and (ii) take up the corresponding power cable when the bow is drawn and the first and second draw cable pulleys rotate about the corresponding pulley assembly axes; (j) the first and second draw cable pulleys are substantially identical or substantial mirror images of each other, and the first and second power modules are substantially identical or substantial mirror images of each other; (k) the first and second draw cable pulleys and the first and second power modules are structurally arranged so that each one of the one or more first pulley assembly power module positions and the corresponding one of the one or more second pulley assembly power module positions result in a corresponding draw length of the bow and a corresponding draw weight of the bow; (l) the first and second draw cable pulleys and the first and second power modules are structurally arranged so that, for each one of the one or more first pulley assembly power module positions and the corresponding one of the one or more second pulley assembly power module positions, attachment of the first power module to the first draw cable pulley and attachment of the second power module to the second draw cable pulley result in substantially the same draw length of the bow and substantially the same draw weight of the bow as those resulting from attachment of the first power module to the second draw cable pulley and attachment of the second power module to the first draw cable pulley; and (m) the first and second draw cable pulleys and the first and second power modules are structurally arranged so that, for each one of the one or more first pulley assembly power module positions and the corresponding one of the one or more second pulley assembly power module positions, attachment of the first power module to the first draw cable pulley and attachment of the second power module to the second draw cable pulley result in stored energy of the drawn bow that differs from that resulting from attachment of the first power module to the second draw cable pulley and attachment of the second power module to the first draw cable pulley.

EXAMPLE 33

The bow of Example 32 wherein the pulley assemblies are arranged according to any one of Examples 1-11, 15-20, or 24-28.

EXAMPLE 34

A method for adjusting the bow of any one of Examples 32 or 33, the method comprising: (A) removing the first power module from a first one of the one or more first pulley assembly power module positions on the first draw cable pulley; and (B) removing the second power module from the corresponding one of the one or more second pulley assembly power module positions on the first draw cable pulley; (C) attaching the second power module to the first draw cable pulley in the first one of the one or more first pulley assembly power module positions on the first draw cable pulley; and (D) attaching the first power module to the second draw cable pulley in the corresponding one of the one or more second pulley assembly power module positions on the second draw cable pulley, (E) thereby altering the stored energy of the drawn bow without substantially altering the draw length of the bow and without substantially altering the draw weight of the bow.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 (f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A first pulley assembly for a compound archery bow, the first pulley assembly comprising a draw cable pulley and a power module substantially rigidly attached to the draw cable pulley, wherein:

(a) the draw cable pulley is structurally arranged so as to (i) define a first pulley assembly transverse rotation axis, (ii) be mounted on a first limb of an archery bow to rotate about the first pulley assembly axis, (iii) receive a first end of a draw cable of the bow in a circumferential draw cable journal of the draw cable pulley, and (iv) let out the first end of the draw cable when the bow is drawn and the draw cable pulley rotates about the first pulley assembly axis;

(b) one or both of the draw cable pulley and the power module are structurally arranged so as to enable substantially rigid attachment of the power module to the draw cable pulley in any one of one or more power module positions and, for each power module position, in any one of two power module orientations;

(c) the power module is structurally arranged so as to (i) receive a power cable of the bow in a circumferential power cable journal of the power module, and (ii) take up the power cable when the bow is drawn and the draw cable pulley rotates about the first pulley assembly axis; and (d) each one of the one or more power module positions results in a corresponding draw length of the bow and a corresponding draw weight of the bow;

(e) for each one of the one or more power module positions, the two power module orientations result in substantially the same draw length of the bow and substantially the same draw weight of the bow; and (f) for each one of the one or more power module positions, the two power module orientations result in differing stored energies of the drawn bow.

2. A method for adjusting the pulley assembly of claim 1, the method comprising:

(A) removing the power module from a first one of the one or more power module positions and a first one of the two power module orientations on the draw cable pulley; and (B) reattaching the power module to the draw cable pulley in the first one of the one or more power module positions and in the other one of the two power module orientations, (C) thereby altering the stored energy of the drawn bow without substantially altering the draw length of the bow and without substantially altering the draw weight of the bow.

3. The pulley assembly of claim 1 wherein:

(b') one or both of the draw cable pulley and the power module are structurally arranged so as to enable substantially rigid attachment of the power module to the draw cable pulley in any one of multiple power module positions; and (d') each one of the one or more power module positions results in (i) a corresponding draw length of the bow that differs from draw lengths corresponding to other power module positions, or (ii) a corresponding draw weight of the bow that differs from draw weights corresponding to other power module positions.

4. A method for adjusting the pulley assembly of claim 3, the method comprising:

(A) removing the power module from a first one of the multiple power module positions and a first one of the two power module orientations on the draw cable pulley; and (B) reattaching the power module to the draw cable pulley in a different one of the multiple power module positions and in one of the two power module orientations, thereby altering the draw length of the bow or the draw weight of the bow.

5. The pulley assembly of claim 3 further comprising a mounting member, wherein (i) one or both of the mounting member and the draw cable pulley are structurally arranged so as to enable substantially rigid attachment of the mounting member to the draw cable pulley in any one of multiple mounting member positions, (ii) one or both of the mounting member and the power module are structurally arranged so as to enable substantially rigid attachment of the power module to the mounting member in any one of the one or more power module positions, and (iii) attachment of the power module to the mounting member and attachment of the mounting member to the power cable pulley provides the substantially rigid attachment of the power module to the draw cable pulley.

6. The pulley assembly of claim 3 wherein the multiple power module positions comprise a set of discrete positions of the power module on the draw cable pulley.

7. The pulley assembly of claim 6 wherein one or both of the draw cable pulley and the power module are structurally arranged to engage each other, in both of the two power module orientations, to mechanically index each one of the discrete positions of the power module on the draw cable pulley.

8. The pulley assembly of claim 3 further comprising a rotation stop substantially rigidly attached to the draw cable pulley, wherein one or both of the draw cable pulley and the rotation stop are structurally arranged so as to enable substantially rigid attachment of the rotation stop to the draw cable pulley in any one of multiple rotation stop positions corresponding to the draw lengths resulting from the multiple power module positions.

9. A method for adjusting the pulley assembly of claim 8, the method comprising:

(A) removing the power module from a first one of the multiple power module positions and a first one of the two power module orientations on the draw cable pulley; and (B) reattaching the power module to the draw cable pulley in a different one of the multiple power module positions and in one of the two power module orientations, thereby altering the draw length of the bow, (C) wherein the method further comprises moving the rotation stop from a first one of the multiple rotation stop positions and substantially rigidly attaching the rotation stop to the draw cable pulley in a second, different one of the multiple rotation stop positions that corresponds to the altered draw length.

10. The pulley assembly of claim 8 wherein: the multiple power module positions comprise a set of discrete positions of the power module on the draw cable pulley; the multiple rotation stop positions comprise a set of discrete positions; and each one of the discrete rotation stop positions corresponds to one of the discrete power module positions.

11. The pulley assembly of claim 1 wherein the two power module orientations differ by rotation of the power module about an axis substantially perpendicular to the first pulley rotation axis and by opposing faces of the power module being positioned against the draw cable pulley.

12. The pulley assembly of claim 1 wherein the two power module orientations differ by rotation of the power module about an axis substantially parallel to the first pulley rotation axis with the same face of the power module remaining positioned against the draw cable pulley.

13. The pulley assembly of claim 1 wherein the pulley assembly further comprises a cable let-out pulley substantially rigidly attached to the draw cable pulley or the power module, wherein the cable let-out pulley is structurally arranged so as to (i) receive an additional cable of the bow in a circumferential cable journal of the cable let-out pulley, and (ii) let out the additional cable when the bow is drawn and the draw cable pulley rotates about the first pulley assembly axis.

14. The pulley assembly of claim 1 further comprising a second pulley assembly for the compound archery bow, the second pulley assembly comprising a second draw cable pulley and a second power module substantially rigidly attached to the second draw cable pulley, wherein:

(a') the second draw cable pulley is structurally arranged so as to (i) define a second pulley assembly transverse rotation axis substantially parallel to the first pulley assembly axis, (ii) be mounted on a second limb of the archery bow to rotate about the second pulley assembly axis, (iii) receive a second end of the draw cable of the bow in a circumferential draw cable journal of the second draw cable pulley, and (iv) let out the second end of the draw cable when the bow is drawn and the second draw cable pulley rotates about the second pulley assembly axis;

(b') one or both of the second draw cable pulley and the second power module are structurally arranged so as to enable substantially rigid attachment of the second power module to the second draw cable pulley in any one of one or more second power module positions and, for each second power module position, in any one of two second power module orientations;

(c') the second power module is structurally arranged so as to (i) receive a second power cable of the bow in a circumferential power cable journal of the second power module, and (ii) take up the second power cable when the bow is drawn and the second draw cable pulley rotates about the second pulley assembly axis;

(d') each one of the one or more second power module positions results in a corresponding draw length of the bow and a corresponding draw weight of the bow;

(e') for each one of the one or more second power module positions, the two second power module orientations result in substantially the same draw length of the bow and substantially the same draw weight of the bow; and (f') for each one of the one or more second power module positions, the two second power module orientations result in differing stored energies of the drawn bow.

15. A compound archery bow, comprising:

(a) a central riser;

(b) first and second bow limbs secured to opposing ends of the riser;

(c) a first pulley assembly rotatably mounted on the first bow limb;

(d) either an idler wheel or a second pulley assembly rotatably mounted on the second bow limb;

(e) a draw cable; and (f) a power cable, wherein:

(g) the first pulley assembly comprises a draw cable pulley and a power module substantially rigidly attached to the draw cable pulley;

(h) the draw cable pulley is structurally arranged so as to (i) define a first pulley assembly transverse rotation axis, (ii) be mounted on the first limb of the bow to rotate about the first pulley assembly axis, (iii) receive a first end of the draw cable in a circumferential draw cable journal of the draw cable pulley, and (iv) let out the first end of the draw cable when the bow is drawn and the draw cable pulley rotates about the first pulley assembly axis;

(i) one or both of the draw cable pulley and the power module are structurally arranged so as to enable substantially rigid attachment of the power module to the draw cable pulley in any one of one or more power module positions and, for each power module position, in any one of two power module orientations;

(j) the power module is structurally arranged so as to (i) receive the power cable in a circumferential power cable journal of the power module, and (ii) take up the power cable when the bow is drawn and the draw cable pulley rotates about the first pulley assembly axis; and (k) each one of the one or more power module positions results in a corresponding draw length of the bow and a corresponding draw weight of the bow;

(l) for each one of the one or more power module positions, the two power module orientations result in substantially the same draw length of the bow and substantially the same draw weight of the bow; and (m) for each one of the one or more power module positions, the two power module orientations result in differing stored energies of the drawn bow.

16. A method for adjusting the bow of claim 15, the method comprising:

(A) removing the power module from a first one of the one or more power module positions and a first one of the two power module orientations on the draw cable pulley; and (B) reattaching the power module to the draw cable pulley in the first one of the one or more power module positions and in the other one of the two power module orientations, (C) thereby altering the stored energy of the drawn bow without substantially altering the draw length of the bow and without substantially altering the draw weight of the bow.

17. The bow of claim 15 wherein:

(b') one or both of the draw cable pulley and the power module are structurally arranged so as to enable substantially rigid attachment of the power module to the draw cable pulley in any one of multiple power module positions; and (d') each one of the one or more power module positions results in (i) a corresponding draw length of the bow that differs from draw lengths corresponding to other power module positions, or (ii) a corresponding draw weight of the bow that differs from draw weights corresponding to other power module positions.

18. A method for adjusting the bow of claim 17, the method comprising:

(A) removing the power module from a first one of the multiple power module positions and a first one of the two power module orientations on the draw cable pulley; and (B) reattaching the power module to the draw cable pulley in a different one of the multiple power module positions and in one of the two power module orientations, thereby altering the draw length of the bow or the draw weight of the bow.

19. The bow of claim 17 wherein (i) the first pulley assembly further comprises a mounting member, (i) one or both of the mounting member and the draw cable pulley are structurally arranged so as to enable substantially rigid attachment of the mounting member to the draw cable pulley in any one of multiple mounting member positions, (ii) one or both of the mounting member and the power module are structurally arranged so as to enable substantially rigid attachment of the power module to the mounting member in any one of the one or more power module positions, and (iii) attachment of the power module to the mounting member and attachment of the mounting member to the power cable pulley provides the substantially rigid attachment of the power module to the draw cable pulley.

20. The bow of claim 17 wherein the multiple power module positions comprise a set of discrete positions of the power module on the draw cable pulley.

21. The bow of claim 20 wherein one or both of the draw cable pulley and the power module are structurally arranged to engage each other, in both of the two power module orientations, to mechanically index each one of the discrete positions of the power module on the draw cable pulley.

22. The bow of claim 17 further comprising a rotation stop substantially rigidly attached to the draw cable pulley, wherein one or both of the draw cable pulley and the rotation stop are structurally arranged so as to enable substantially rigid attachment of the rotation stop to the draw cable pulley in any one of multiple rotation stop positions corresponding to the draw lengths resulting from the multiple power module positions.

23. A method for adjusting the bow of claim 22, the method comprising:

(A) removing the power module from a first one of the multiple power module positions and a first one of the two power module orientations on the draw cable pulley; and (B) reattaching the power module to the draw cable pulley in a different one of the multiple power module positions and in one of the two power module orientations, thereby altering the draw length of the bow, (C) wherein the method further comprises moving the rotation stop from a first one of the multiple rotation stop positions and substantially rigidly attaching the rotation stop to the draw cable pulley in a second, different one of the multiple rotation stop positions that corresponds to the altered draw length.

24. The bow of claim 22 wherein: the multiple power module positions comprise a set of discrete positions of the power module on the draw cable pulley; the multiple rotation stop positions comprise a set of discrete positions; and each one of the discrete rotation stop positions corresponds to one of the discrete power module positions.

25. The bow of claim 15 wherein the two power module orientations differ by rotation of the power module about an axis substantially perpendicular to the first pulley rotation axis and by opposing faces of the power module being positioned against the draw cable pulley.

26. The bow of claim 15 wherein the two power module orientations differ by rotation of the power module about an axis substantially parallel to the first pulley rotation axis with the same face of the power module remaining positioned against the draw cable pulley.

27. The bow of claim 15 further comprising the second pulley assembly, wherein the second pulley assembly includes a power cable let-out pulley that is structurally arranged so as to (i) receive the power cable in a circumferential power cable journal of the power cable let-out pulley, and (ii) let out the second power cable when the bow is drawn and the draw cable pulley rotates about the first pulley assembly axis.

28. The bow of claim 15 further comprising the second pulley assembly and a second power cable, wherein:

(g') the second pulley assembly comprises a second draw cable pulley and a second power module substantially rigidly attached to the second draw cable pulley;

(h') the second draw cable pulley is structurally arranged so as to (i) define a second pulley assembly transverse rotation axis substantially parallel to the first pulley assembly axis, (ii) be mounted on the second limb of the bow to rotate about the second pulley assembly axis, (iii) receive a second end of the draw cable in a circumferential draw cable journal of the second draw cable pulley, and (iv) let out the second end of the draw cable when the bow is drawn and the second draw cable pulley rotates about the second pulley assembly axis;

(i') one or both of the second draw cable pulley and the second power module are structurally arranged so as to enable substantially rigid attachment of the second power module to the second draw cable pulley in any one of one or more second power module positions and, for each second power module position, in any one of two second power module orientations;

(j') the second power module is structurally arranged so as to (i) receive a second power cable of the bow in a circumferential power cable journal of the second power module, and (ii) take up the second power cable when the bow is drawn and the second draw cable pulley rotates about the second pulley assembly axis;

(k') each one of the one or more second power module positions results in a corresponding draw length of the bow and a corresponding draw weight of the bow;

(l') for each one of the one or more second power module positions, the two second power module orientations result in substantially the same draw length of the bow and substantially the same draw weight of the bow; and (m') for each one of the one or more second power module positions, the two second power module orientations result in differing stored energies of the drawn bow.

29. The bow of claim 28 wherein:

(n) the first pulley assembly further comprises a first power cable let-out pulley substantially rigidly attached to the draw cable pulley or the power module;

(o) the first power cable let-out pulley is structurally arranged so as to (i) receive the second power cable of the bow in a circumferential power cable journal of the first power cable let-out pulley, and (ii) let out the second power cable when the bow is drawn and the draw cable pulley rotates about the first pulley assembly axis;

(p) the second pulley assembly further comprises a second power cable let-out pulley substantially rigidly attached to the second draw cable pulley or the second power module; and (q) the second power cable let-out pulley is structurally arranged so as to (i) receive the first power cable of the bow in a circumferential power cable journal of the second power cable let-out pulley, and (ii) let out the first power cable when the bow is drawn and the second draw cable pulley rotates about the second pulley assembly axis.

30. The bow of claim 15 further comprising the idler wheel, wherein:

(n) the first pulley assembly further comprises a draw cable let-out pulley substantially rigidly attached to the first draw cable pulley or the power module; and (o) the draw cable let-out pulley is structurally arranged so as to (i) receive a second end of the draw cable in a circumferential draw cable journal of the draw cable let-out pulley, and (ii) let out the second end of the draw cable, with the draw cable passing around the idler wheel, when the bow is drawn and the draw cable pulley rotates about the first pulley assembly axis.

31. The bow of claim 15 further comprising the second pulley assembly and a coupling cable, wherein:

(n) the first pulley assembly further comprises a coupling cable let-out pulley substantially rigidly attached to the draw cable pulley or the power module;

(o) the second pulley assembly comprises a second draw cable pulley and a coupling cable take-up pulley;

(p) the second draw cable pulley is structurally arranged so as to (i) receive a second end of the draw cable in a circumferential draw cable journal of the second draw cable pulley, and (ii) let out the second end of the draw cable when the bow is drawn and the second pulley assembly rotates about the second pulley assembly axis;

(q) the coupling cable take-up pulley is structurally arranged so as to (i) receive a first end of the coupling cable in a circumferential coupling cable journal of the coupling cable take-up pulley, and (ii) take up the first end of the coupling cable when the bow is drawn and the second pulley assembly rotates about the second pulley assembly axis; and (r) the coupling cable let-out pulley is structurally arranged so as to (i) receive a second end of the coupling cable in a circumferential coupling cable journal of the coupling cable let-out pulley, and (ii) let out the second end of the coupling cable when the bow is drawn and the first pulley assembly rotates about the first pulley assembly axis.

32. A compound archery bow, comprising:

(a) a central riser;

(b) first and second bow limbs secured to opposing ends of the riser;

(c) a first draw cable pulley rotatably mounted on the first bow limb;

(d) a second draw cable pulley rotatably mounted on the second bow limb;

(e) first and second power modules; and (f) a draw cable and two power cables, wherein:

(g) each one of the first and second draw cable pulleys is structurally arranged so as to (i) define a corresponding pulley assembly transverse rotation axis, (ii) be mounted on the corresponding limb of the bow to rotate about the corresponding pulley assembly axis, (iii) receive a corresponding end of the draw cable in a corresponding circumferential draw cable journal, and (iv) let out the corresponding end of the draw cable when the bow is drawn and the first and second draw cable pulleys rotate about the corresponding pulley assembly axes;

(h) the first and second draw cable pulleys, the first and second power modules, or both are structurally arranged so as to enable (i) substantially rigid attachment of one of the first or second power modules to the first draw cable pulley in any one of one or more first pulley assembly power module positions and (ii) substantially rigid attachment of the other of the first or second power modules to the second draw cable pulley in a corresponding one of one or more second pulley assembly power module positions;

(i) each one of the first and second power modules is structurally arranged, when substantially rigidly attached to a corresponding one of the first and second draw cable pulleys, so as to (i) receive a corresponding one of the power cables in a circumferential power cable journal of that power module, and (ii) take up the corresponding power cable when the bow is drawn and the first and second draw cable pulleys rotate about the corresponding pulley assembly axes;

(j) the first and second draw cable pulleys are substantially identical or substantial mirror images of each other, and the first and second power modules are substantially identical or substantial mirror images of each other;

(k) the first and second draw cable pulleys and the first and second power modules are structurally arranged so that each one of the one or more first pulley assembly power module positions and the corresponding one of the one or more second pulley assembly power module positions result in a corresponding draw length of the bow and a corresponding draw weight of the bow;

(l) the first and second draw cable pulleys and the first and second power modules are structurally arranged so that, for each one of the one or more first pulley assembly power module positions and the corresponding one of the one or more second pulley assembly power module positions, attachment of the first power module to the first draw cable pulley and attachment of the second power module to the second draw cable pulley result in substantially the same draw length of the bow and substantially the same draw weight of the bow as those resulting from attachment of the first power module to the second draw cable pulley and attachment of the second power module to the first draw cable pulley; and (m) the first and second draw cable pulleys and the first and second power modules are structurally arranged so that, for each one of the one or more first pulley assembly power module positions and the corresponding one of the one or more second pulley assembly power module positions, attachment of the first power module to the first draw cable pulley and attachment of the second power module to the second draw cable pulley result in stored energy of the drawn bow that differs from that resulting from attachment of the first power module to the second draw cable pulley and attachment of the second power module to the first draw cable pulley.

33. A method for adjusting the bow of claim 32, the method comprising:

(A) removing the first power module from a first one of the one or more first pulley assembly power module positions on the first draw cable pulley; and (B) removing the second power module from the corresponding one of the one or more second pulley assembly power module positions on the first draw cable pulley;

(C) attaching the second power module to the first draw cable pulley in the first one of the one or more first pulley assembly power module positions on the first draw cable pulley; and (D) attaching the first power module to the second draw cable pulley in the corresponding one of the one or more second pulley assembly power module positions on the second draw cable pulley, (E) thereby altering the stored energy of the drawn bow without substantially altering the draw length of the bow and without substantially altering the draw weight of the bow.

* * * * *